US008424935B2

(12) United States Patent
Moon

(10) Patent No.: US 8,424,935 B2
(45) Date of Patent: Apr. 23, 2013

(54) MORTISE LOCK ASSEMBLY

(75) Inventor: Charles W. Moon, Colorado Springs, CO (US)

(73) Assignee: Townsteel, Inc., City of Industry, CA (US)

( * ) Notice: Subject to any disclaimer, the term of this patent is extended or adjusted under 35 U.S.C. 154(b) by 0 days.

(21) Appl. No.: 13/451,294

(22) Filed: Apr. 19, 2012

(65) Prior Publication Data

US 2012/0198896 A1 Aug. 9, 2012

Related U.S. Application Data

(63) Continuation of application No. 12/424,091, filed on Apr. 15, 2009, now Pat. No. 8,292,336.

(51) Int. Cl.

| | |
|---|---|
| ***E05B 15/10*** | (2006.01) |
| ***E05B 17/00*** | (2006.01) |
| ***E05B 15/00*** | (2006.01) |

(52) U.S. Cl.

USPC ..... 292/244; 292/163; 292/169; 292/336.5; 70/107

(58) Field of Classification Search ..... 292/1, 32, 292/33, 34; 70/107, 144

See application file for complete search history.

(56) References Cited

U.S. PATENT DOCUMENTS

| | | | | |
|---|---|---|---|---|
| 269,098 | A * | 12/1882 | Niles | 292/165 |
| 286,580 | A * | 10/1883 | Billings | 292/245 |
| 3,750,433 | A * | 8/1973 | Sanders | 70/486 |
| 6,581,423 | B2 * | 6/2003 | Lin | 70/107 |
| 6,647,753 | B2 * | 11/2003 | Engler | 70/472 |
| 6,993,946 | B1 * | 2/2006 | Shen | 70/472 |
| 7,377,140 | B2 * | 5/2008 | Shen et al. | 70/107 |
| 7,497,486 | B1 * | 3/2009 | Davis et al. | 292/32 |
| 7,603,880 | B2 * | 10/2009 | Chen | 70/107 |
| 8,201,858 | B1 * | 6/2012 | Moon et al. | 292/164 |
| 2010/0140962 | A1 * | 6/2010 | Kim | 292/165 |

* cited by examiner

*Primary Examiner* — Thomas Beach
*Assistant Examiner* — Faria Ahmad
(74) *Attorney, Agent, or Firm* — Eric W. Cernyar

(57) ABSTRACT

A mortise lock is provided with independently rotatable spindles and a highly accessible lock-handing selector. Also, a clutching mortise lock is provided that enables operative rotation in both directions to retract the latch.

19 Claims, 16 Drawing Sheets

MORTISE LOCK ASSEMBLY

CROSS REFERENCE TO RELATED APPLICATIONS

This application is a continuation of and claims priority to U.S. application Ser. No. 12/424,091, filed Apr. 15, 2009, also entitled "Mortise Lock Assembly."

FIELD OF THE INVENTION

This invention relates generally to locks, and more specifically, to mortise locks.

BACKGROUND OF THE INVENTION

Mortise locksets are a type of lock that is fitted into a rectangular cavity, called a "mortise," that is cut into the side of a door. Mortise locksets typically comprise a rectangular lock body that is inserted into the mortise, lock trim (including inside and outside trim plates, doorknobs, and/or door handles), a strike plate or box keep that lines a cavity in the door jamb, and a keyed cylinder that operates the locking/unlocking function. A mortise lockset includes a typically self-latching main bolt or latchbolt, and optionally may also include a deadbolt and/or guardbolt. The lock body typically comprises a case assembly and cover that house the keyed cylinder and several levers, springs, and other moving parts used to bias, extend and/or retract the various bolts.

Mortise locksets come in both door-handle locking and door-handle clutching varieties. FIG. 1 illustrates a prior art mortise lockset operable to lock the outside door handle, preventing its further rotation. One disadvantage of door-handle locking locksets is that turning the outside door handle can place a significant amount of potentially damaging torque on the door-handle-locking mechanism inside the lock body. Door-handle clutching locksets, by contrast, selectively mechanically couple the outside door handle with the latch-retracting works inside the lock body. In this type of lockset, a person can turn the outside door handle to a fully-rotated position, but it will not engage the latch. Moreover, applying pressure to the outside door handle does not place the latch-retracting works inside the lock body under potentially damaging loads.

Mortise locksets are also typically (but not always) "handed," that is, assembled for installation in either a left-hand door or a right-hand door, but not both. Typically, there are at least two handed components of a mortise lock. First, the beveled face of the latchbolt should preferably face the door-closing direction. Second, it is generally preferred that only the outside door handle be access-controlled. The inside door handle should, in most cases, be free at all times to operate the latch-retracting works inside the lock body. Accordingly, the latch-retracting works inside some lock bodies includes two independently spindle-operable hubs, both of which are coupled to a latch-retracting works, but only one of which can be locked or disengaged to prevent access.

To convert a handed mortise lockset assembled for a left-hand installation to one adapted for right-hand installation, or vice-versa, it is often necessary to remove the cover from the case assembly, and then dismount, rotate or reverse, and remount several components (including the latchbolt, guardbolt, and spindle hubs) in the lock body. Often, one or more biasing springs must also be dismounted and remounted—making the conversion process a more difficult and cumbersome process.

FIGS. 1-4*b* illustrate one example of a conventional left-handed mortise latch and lock body assembly 10. The individual components of the assembly 10 are described in greater detail in the detailed description, below. Converting the left-handed mortise latch and lock body assembly 10 into one adapted for right-hand door installation is a tedious and cumbersome process. First, a locksmith must remove the cover 29 from the case assembly 20. Next, the locksmith must dismount the hub assembly 30 from the case assembly 20 and flip them around, as shown in FIG. 2*b*. Next, the locksmith must remove the deadbolt link 66 in order to gain access to the guardbolt assembly 70. Next, as shown in FIG. 4*b*, the locksmith must flip the guardbolt assembly 70 around. Also, as shown in FIG. 3*b*, the locksmith must flip the latchbolt 51 around. The locksmith must also remount the blocker assembly 80 and deadbolt link 66 and re-attach the cover 29 to the case assembly 20.

Not all mortise locksets require so cumbersome a process to reverse their handing. U.S. Pat. No. 6,619,705 to Dalsing, which is herein incorporated by reference, discloses a clutching mortise lockset that can be converted from a left-handed to a right-handed adaptation, or vice versa, without removing the cover or front plate of the lock body from the case assembly or back plate of the lock body. To convert the internal clutching mechanism from a left-handed to a right-handed outside-door-handle-disabling adaptation, a person can remove a screw 232 from the back plate of the lock body and replace it on the front plate of the lock body (or vice-versa). But with a typical installation, this conversion must be done while the lock body is outside of the door. So if the lock body has already been installed in the mortise of the door, the installer (in most cases) must remove the lock body to gain access to the screw.

There is a need for mortise locks that provide for less cumbersome conversions from a right-handed to a left-handed adaptation, or vice versa. This need is particularly felt for door-handle disabling locksets.

There is also a need for other improvements in mortise locksets. In a typical mortise lockset, the access-controlled operation of the outside door handle is controlled by a finger-operable arrangement (such as a rocker member or two push buttons) mounted through the face plate of the mortise lockset. The finger-operable arrangement typically operates a stop works that locks and unlocks, or a clutch works that engages or disengages, the outside door handle. However, misalignment of the inside and outside door handles can prevent a person from engaging the stop or clutch works.

Accordingly, there is a need for a mortise lock with an improved escapement mechanism that allows a person to activate a stop works or a clutch works even when the inside and outside door handles are misaligned, so that after a person lets go of the handles, and various springs bias the handles back into alignment, the activated stop works or clutch works succeeds in locking or disengaging the outside door handle.

There is also a need for an improved blocker assembly for a mortise lockset. Many high-end mortise locksets include a guardbolt, which is driven into a retracted position when the door is shut, to prevent an intruder from "loiding" the latchbolt open. The retracted guardbolt engages a blocker assembly that blocks the latchbolt assembly from retracting. However, the blocker assembly is disabled if the outside door handle is in a position that is engaged to retract the latchbolt assembly. If the lockset also includes a finger-operable arrangement in the front plate for restoring the outside door handle to an operating condition, there is a danger—particularly with non-deadbolted mortise locks installed in left- or right-handed "reverse" doors (where the door swings out of the access-restricted space)—that an intruder could "card" the finger operable arrangement in order to disable the blocker.

Accordingly, there is also a need for an improved blocker assembly that will prevent an intruder from "loiding" a mortise lock "stop works" or "clutch works" into an outside-door-handle-operating condition.

SUMMARY OF THE INVENTION

To meet these needs, several new components are provided for a mortise lock. One new component is a spindle-mounted lock-handing selector. Another new component is a non-handed hub clutching assembly. Yet another new component is a clutch-actuator assembly with an escapement mechanism. Yet another new component is a new guardbolt-actuated blocking assembly. The invention is contemplated to cover mortise locksets that encompass any one of these new components or their equivalents and any combination of fewer than all of these new components. The invention is likewise contemplated to cover mortise locksets that address fewer than all of the disadvantages or needs cited in the Background section.

Several embodiments of some very particular mortise locksets are provided to illustrate various aspects of the invention. The invention, however, should not be deemed to be limited to all of these particulars except to the extent those particulars are recited in the claims.

In one embodiment, a mortise lockset is provided comprising a latchbolt, a latch retractor operable to retract the latchbolt, a hub assembly operable to drive the latch retractor into a latchbolt-retracting position, two handle-operated spindles engaging the hub assembly, a lock-handing selector, and a user-actuated clutch. The lock-handing selector is operable to enable selection of one of the spindles to operate the hub assembly to drive the latch retractor into a latchbolt-retracting position. The user-actuated clutch is operable between engaged and disengaged positions, respectively, to rotationally interlock an otherwise inoperative spindle with a latch retracting actuating portion of the hub assembly. Moreover, operative rotation of either handle-operated spindle does not rotate the opposite handle-operated spindle, even when the user-actuated clutch is engaged.

In a more detailed embodiment, the hub assembly comprises an outer coaxial cam subassembly and a spindle hub subassembly operable, via a clutch mechanism, to be selectively coupled with the coaxial cam subassembly. The clutch mechanism comprises a user-actuated clutch operable to selectively couple the spindle hub subassembly to the coaxial cam subassembly. The clutch includes two clutch links or dogs carried by a lever between a hub-coupling position and a hub-decoupling position.

In a yet more detailed embodiment, a faceplate-accessible user-selectable clutchworks is operatively coupled to the user-actuated clutch. The clutchworks—which in one embodiment comprises a pair of parallel, interlinked slides geared to reciprocate in opposite directions—is operable to drive a clutch lever arm and the clutch links it carries between engaged and disengaged positions. An escapement mechanism enables reciprocating operation of the clutchworks when the spindle hub subassembly is misaligned with the coaxial cam subassembly.

In another more detailed embodiment, the lock-handing selector is a type of spindle-mounted link or locker, such as a pin, that couples one of the spindle hubs to a coaxial cam for coordinated rotation. Advantageously, the lock-handing selector is operable to be removed from one spindle and replaced on an opposite spindle without opening the lock body housing the latch retractor and hub assembly, and while the lock body is installed in a door mortise.

In another embodiment, a reversible clutching mortise lock is provided comprising a lock body; a latchbolt operable to be retracted within the lock body; a link assembly coupled to the latchbolt; a first (outer) hub subassembly with cam projections operable to cam the link assembly into a latchbolt-retracting position; and a spindle hub subassembly comprising a pair of independently rotatable spindle hubs that are each independently interlockable with the first hub subassembly. A pair of independently operable spindles are at least partially inserted into the lock body, each being operable to engage and rotate one of the spindle hubs. An inside door handle is mounted on and operable to rotate one of the spindles. An access-controlled door handle is mounted on and operable to rotate another of the spindles.

A reversible lock-handing selector is operable to couple together a selected one of the spindle hubs with the first hub subassembly without coupling together the other of the pair of spindle hubs. The reversible lock-handing selector is adapted for selective installation on either side of the lock body depending on whether the door is a left-handed door or a right-handed door, so that the lock can be installed on either a left-handed or a right-handed door while keeping the inside door handle regularly operable to retract the latchbolt.

A clutch is operable to selectively couple at least one of the spindle hubs with the first hub subassembly. The clutch, which comprises one or more clutch links or dogs, is adapted to enable the outside door handle to retract the latchbolt, when the locker assembly is in a hub-coupling position, whether the lock is installed on a left-handed or a right-handed door. When coupled together, the access-controlled door handle is operable to retract the latchbolt. When decoupled, the outside door handle, when rotated, is inoperable to retract the latchbolt.

To accommodate the clutch links, each of the spindle hubs includes a slot adapted for engagement with the lockers. The first hub subassembly also includes one or more clutch-link-engaging slots adapted for engagement with the one or more clutch links. Each of the one or more clutch links is adapted to retract within one of the clutch-link-engaging slots of the first hub subassembly in order to decouple the corresponding spindle hub.

The clutch links are carried between hub-coupling and non-hub-coupling positions by a pivotally-mounted lever arm. A pair of interconnected slides are operative to urge the lever arm up or down. A leaf spring mounted on one of the slides is operative, in a spring-enabling position of the slide, to bias the lever arm toward a hub-coupling position. The leaf spring is inoperative, in a spring-disabling position of the slide, to bias the lever arm toward a hub-coupling position.

In yet another embodiment, a mortise lock comprises a door latch; a stem attached to and operable to retract the door latch; a link assembly coupled to the stem; a first hub rotatable about an axis operable to engage the link assembly to retract the door latch; a spindle hub operable to be rotated about said axis either independently from rotation of the first hub or in interlocking rotation with the first hub; an outside door handle; and a spindle associated with the outside door handle and operable to engage and rotate the spindle hub.

The mortise lock also comprises a clutch link operative between a hub-coupling position in which the clutch link interlocks the first and second hubs together and a hub-decoupling position in which the clutch link does not interlock the first and second hubs together. A first spring urges the spindle hub into an aligned position with the first hub. The aligned position enables the clutch link to move into the hub-coupling position to interlock the first and second hubs together. In the hub-coupling position, the outside door handle or knob is operable to retract the door latch.

An escapement mechanism, comprising a spring mounted on a slide, is provided that is operable to bias the clutch link toward the hub-coupling position. More particularly, the second spring is operative to bias a pivotally-mounted lever—which is operative to carry the clutch link between coupled and decoupled positions—toward the hub-coupling position. The slide is operative between a spring-enabling position and a spring-disabling position. In the spring-enabling position, the spring is positioned to bias the lever, and in turn the clutch link, toward the hub-coupling position. In the spring-disabling position, the spring is not positioned to bias the lever, and in turn the clutch link, toward the hub-coupling position.

In yet another embodiment, a mortise lockset is provided comprising a lock body; a latchbolt retractable within the lock body; a latch retractor assembly, operable to retract the latchbolt, within the lock body; a hub assembly coupled to two spindles for operating the latch retractor assembly; inside and outside door handles mounted to the spindles; and a guardbolt assembly operable to be triggered by closing a door in which the mortise lockset is mounted.

An outside-door-handle-disabling works, of either the locking or clutching variety, is operative between an outside-door-handle-enabling position and an outside-door-handle-disabling position. In the outside-door-handle-disabling position, the outside-door-handle-disabling works is operable, through interaction with the hub assembly, to selectively disable the outside door handle from operating the latch retractor assembly, without disabling the inside door handle from operating the latch retractor assembly.

A blocker assembly is provided that is operative, when the guardbolt assembly is triggered, to block the outside-door-handle-disabling works from moving from an outside-door-handle-disabling position to an outside-door-handle-enabling position. The blocker assembly, comprising a spring mounted on a blocker, is pivotally mounted on the lock body. The blocker assembly is free to pivot when the outside-door-handle-disabling works is in the outside-door-handle-disabling position, but is not free to pivot when the outside-door-handle-disabling works is in the outside-door-handle-enabling position. The spring of the blocker assembly has an extended arm positioned so that the guardbolt assembly, when triggered, engages the extended arm to either pivot the blocker, if the blocker is free to pivot, or to deform the extended arm, if the blocker is not free to pivot.

DETAILED DESCRIPTION

In describing preferred and alternate embodiments of the technology described herein, as illustrated in FIGS. 1-39, specific terminology is employed for the sake of clarity. The technology described herein, however, is not intended to be limited to the specific terminology so selected, and it is to be understood that each specific element includes all technical equivalents that operate in a similar manner to accomplish similar functions.

I. Conventional Elements

Figure 8:
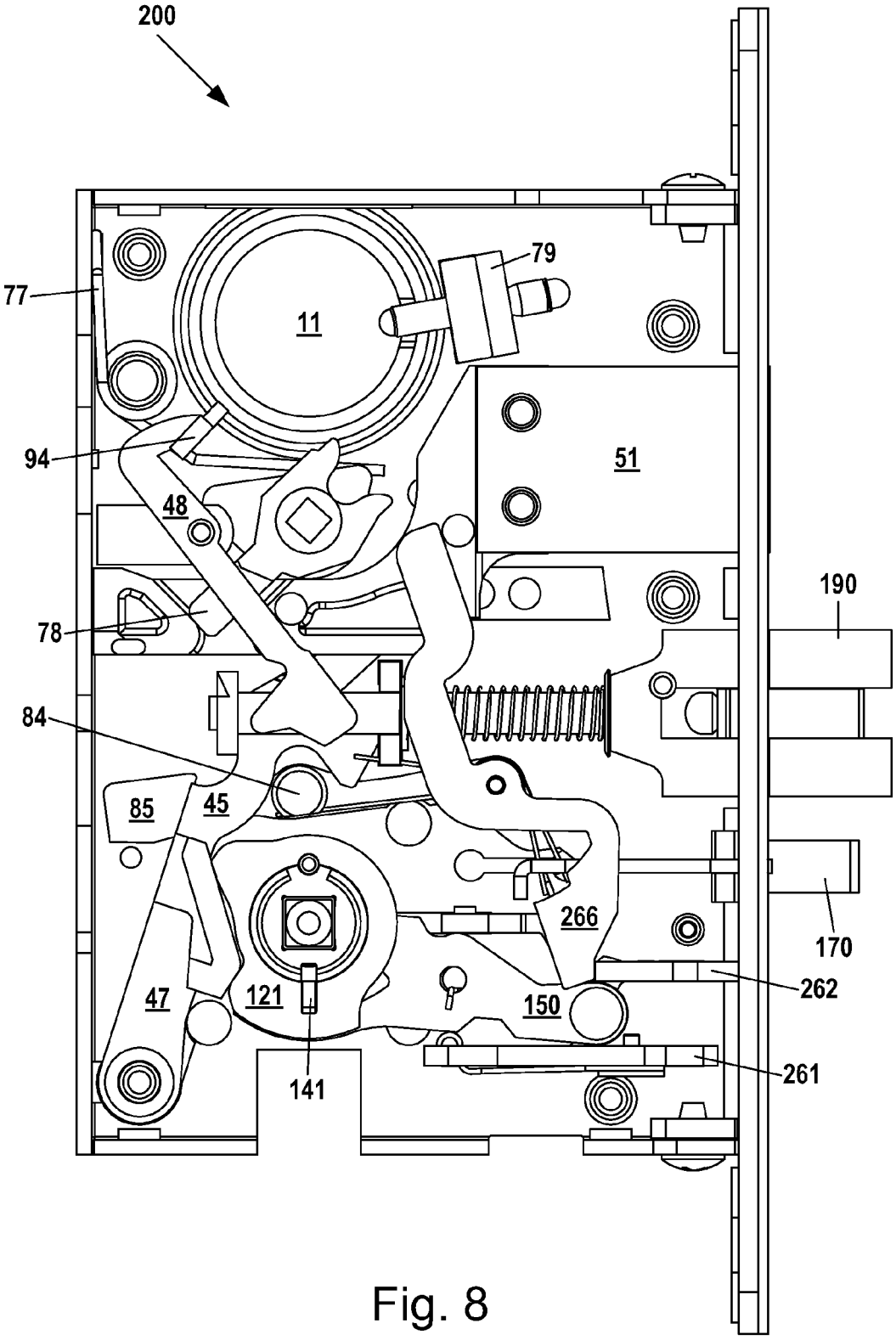
FIG. 8 is a partially cut-away side view of the mortise lockset of FIG. 5, showing the deadbolt in the retracted position and a hub clutching assembly in a hub-coupling position.
Figure 9:
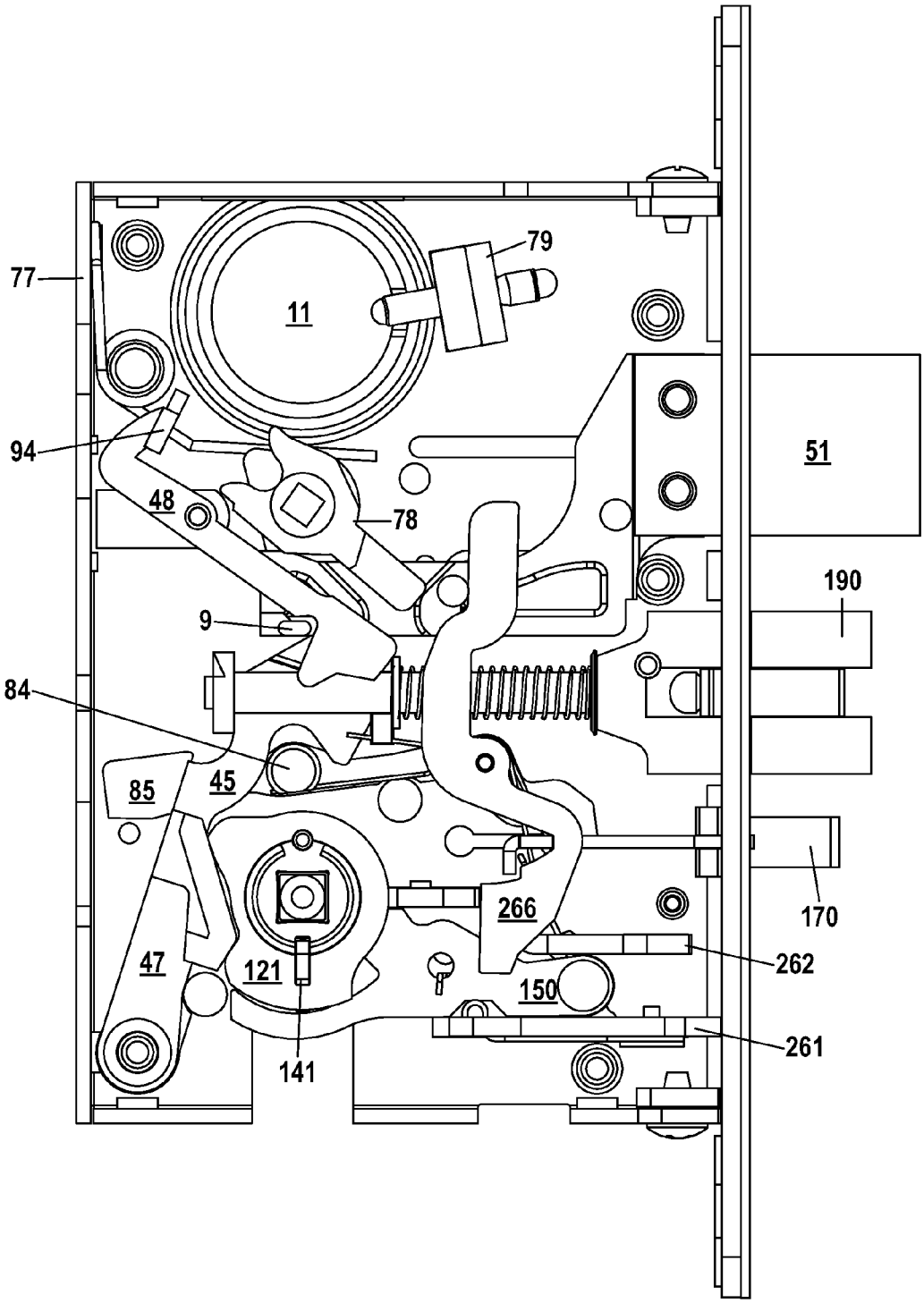
FIG. 9 is another partially cut-away side view of the mortise lockset of FIG. 5, showing the deadbolt in an extended position and the hub clutching assembly in a hub-decoupling position.

To highlight some of the novel components in the present invention, comparison is made with FIGS. 1-4*b*, which illustrates a prior art mortise latch and lock body 10. The interaction of some of the conventional elements is also revealed in FIGS. 8 and 9. It should be noted, however, that FIGS. 8 and 9 are not prior art locksets, because they contain several new elements according to the present invention.

The mortise latch and lock body assembly 10 mounts in a door opposite a strike plate on a doorjamb (not shown). The assembly 10 includes a steel housing or lockset case comprising a case assembly 20 and cover 29. The assembly 10 also includes a deadbolt assembly 15, a hub assembly 30, a principal latch retractor assembly 40, a secondary, key-operated latch retractor 48, a main bolt or latchbolt assembly 50, a stop works assembly 60, an auxiliary latch or guardbolt assembly 70, a blocker assembly 80, an inside front plate 90, also referred to as an armor plate, and an outside front plate 95, also referred to as a scalp plate or face plate.

The case assembly 20 comprises a case 21 with several parts—including interiorly threaded posts 22-26, pivot shaft or pin 27, and latchbolt stem guide 28—stacked on the case 21. Exteriorly threaded case screws 19 secure the cover 29 to the posts 22-26 of the case 21. A tap hole 11 is provided for a keyed cylinder assembly 98 that is mounted in the case assembly 20. A screw block and cylinder screw assembly 79 mounted in corresponding slots 12 in the case 21 and cover 29 is provided to secure the keyed cylinder assembly 98 within the case assembly 20. The keyed cylinder assembly 98 has a key-operated teardrop cam 97 and ear cams 96 that interact with bistable deadbolt cam or hub 78 and the paddle 94 of the key-operated latch retractor 48 to operate the deadbolt 16 and latchbolt 51. Deadbolt cam 78 is spring-biased in either the fully retracted or fully extended positions by deadbolt cam spring 77.

The hub assembly 30 is coupled by spindles (not shown) to the inside and outer door knobs or handles (also not shown). The hub assembly 30 comprises an outer locking hub 31, an inner, non-locking hub 32, and a hub spacer or bushing 33. The outer hub 31—sometimes referred to as an exterior operating cam—is coupled to the outside door knob or handle. The inner hub 32—sometimes referred to as an interior operating cam—is coupled to the inside door knob or handle. The bushing 33 separates hubs 31 and 32. Hubs 31 and 32, which are independently rotatable, are journaled in circular journal apertures 13 and 14, respectively, in the cover 29 and case 21. Both hubs 31 and 32 have divaricate cam surfaces 34 and 35 that, when rotated, and regardless of the direction they are rotated, drive the principal latch retractor assembly 40 in a counter-clockwise direction (in relation to FIG. 1's perspective), into a retracted position. The principal latch retractor assembly 40, when driven in the counter-clockwise direction, retracts the latchbolt assembly 50 into the case assembly 20.

The principal latch retractor assembly 40 is pivotally mounted on post 23, which doubles as a pivot shaft. The principal latch retractor assembly 40 comprises a lower latch retractor or biasing lever 43, a biasing spring 44 that biases the biasing lever 43 in a clockwise direction (in relation to FIG. 1's perspective), and a latch retractor arm or operating lever 45. The biasing lever 43 has a roof-shaped face 47 that engages the cam surfaces 34 and 35 of the hub assembly 30, biasing the hub assembly into a default orientation and the hubs 31 and 32 into alignment with each other. Turning one of the door knobs or handles (not shown) causes one of the cam surfaces 34 or 35 to drive the biasing lever 43—and the operating lever 45 to which it is mounted—back in a counter-clockwise direction. The operating lever 45, in turn, retracts the latchbolt assembly 50 into the case assembly 20.

A secondary, key-operated latch retractor 48 is also provided. FIG. 9 depicts the latch retractor 48 in its most extreme counter-clockwise orientation, where the paddle 94 is out of the way of teardrop cam 97. Turning a key in the keyed cylinder 98 toward the unlocking position (which would be counterclockwise on FIG. 9) turns teardrop cam 97 to drive deadbolt cam 78 clockwise. This retracts the deadbolt 51, causing deadbolt pin 65 to push latch retractor 48 into a paddle-engageable position. As the keyed cylinder 98 is rotated further, the teardrop cam 97 comes into contact with paddle 94 and pivots the secondary latch retractor 48 in a further clockwise direction. This, in turn, pulls the latchbolt assembly 50 into the retracted position (see FIG. 8).

Turning a key in the keyed cylinder 98 toward the locking position (which would be clockwise on FIG. 8) pushes the paddle 94 in the opposite direction, which pivots the secondary latch retractor 48 in the counter-clockwise direction. The latch retractor 48 is then driven to its most extreme counter-clockwise orientation (as shown in FIG. 9) by another deadbolt pin 9.

Figure 3A:
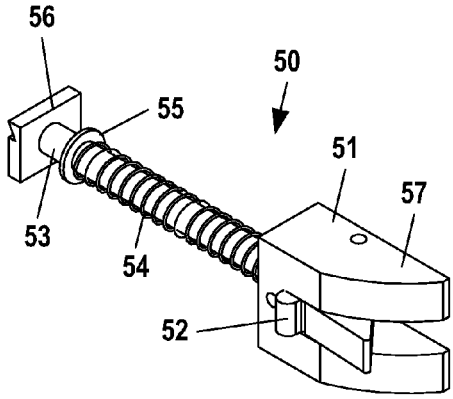
FIGS. 3*a* and 3*b* illustrate how the latchbolt must be turned around to reverse the handing of a lock.
Figure 3B:
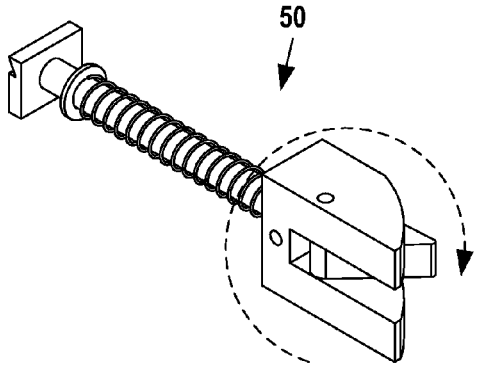
Figure 4A:
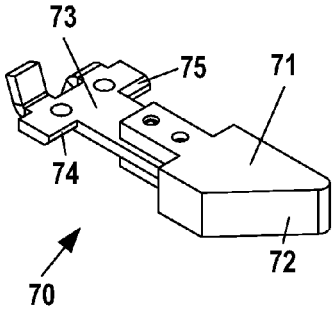
FIGS. 4*a* and 4*b* illustrate a handed guardbolt of the prior art mortise lockset of FIG. 1 that must also be dismounted, flipped around, and remounted in the mortise lock body to reverse the handing of the lock.
Figure 4B:
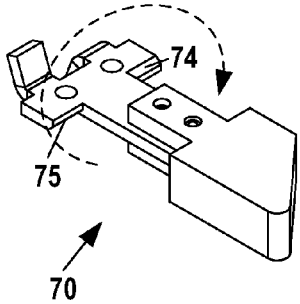
Fig. 4b PRIOR ART

As illustrated in greater detail in FIGS. 3*a* and 3*b*, the main bolt or latchbolt assembly 50 comprises a three-pronged latchbolt 51, including a two-pronged yoke 57 and a pivotally-mounted, trigger-activated single prong 52, a stem or shaft 53, a coil extension spring 54, a washer 55, and a tail plate 56. The stem 53 is mounted in the latchbolt stem guide 28, which doubles as a stop for the coil extension spring 54. The spring 54 presses the washer 55 against the right side (in relation to FIG. 1's perspective) of the latchbolt stem guide 28. The operating lever 45 is mounted in the case assembly 20 so that a head portion 42—which extends from a tail-plate-engaging surface 41 to a blocker engagement arm 46—is positioned between the tail plate 56 and the latchbolt stem guide 28. Also, the latch retractor 48 is mounted in the case assembly 20 so that a head portion 49 is generally positioned between the tail plate 56 and the latchbolt stem guide 28.

The purpose of the stop works assembly 60 is to enable a person to lock or unlock the outside door handle or knob by pressing one of two interlinked buttons 63 and 64 that protrude through opening 92 and recess 93 in front plates 90 and 95. The stop works assembly 60 comprises an upper locking slide 62 and an interlinked lower slide 61. When the upper locking slide 62 moves inward, it engages a slot 36 on hub 31, preventing its rotation. This in turn prevents rotation of the outside door handle or knob. The upper locking slide 62 does not, however, interfere with rotational movement of hub 32. Therefore a person is still free to turn the inside door handle or knob to retract the latchbolt 51 and open the door. The slides 61 and 62 are coupled together by gear 99. Therefore, inward movement of the lower slide 61 causes corresponding outward movement of upper locking slide 62, thereby releasing the hub 31.

The stop works 60 is engaged and disengaged by several mechanisms. A person can press on button 64 to force the slide 62 into engagement with slot 36 of hub 31. Also, projection of the deadbolt assembly 15 into the door jamb causes a deadbolt pin 65 to engage the top 67 of a pivotally-mounted deadbolt lever 66, driving the bottom 68 of the lever 66, which is engaged in a side slot 69 of the upper locking slide 62, in the opposite direction. If the slide 62 is already engaged with slot 36, a person can press on button 63 to disengage it. Also, retraction of the deadbolt assembly 15 drives the lever 66 in reverse, freeing a person to push button 63 to disengage the stop works 60.

The purpose of the auxiliary latch or guardbolt assembly 70 and blocker assembly 80 is to prevent a person from "biding" the latchbolt assembly 50 into a retracted position when the door is shut. The guardbolt assembly 70 comprises a bolt portion 71 with a beveled face 72, a stem 73, and tab ramps 74 and 75. There is no recess in the strike plate (not shown) to receive the guardbolt assembly 70. Consequently, shutting a door having the mortise lock assembly 10 shown in FIG. 1 forces the guardbolt assembly 70 into a retracted position. In the retracted position, and guardbolt assembly 70 engages the blocker assembly 80 to prevent the latchbolt assembly 50 from retracting, unless the hub assembly 30 is engaged to retract the latchbolt assembly 30.

The blocker assembly 80 comprises a cam arm 81, a bushing 86, a blocker spring 87, and a guardbolt or auxiliary latch spring 88, all of which are mounted on pivot shaft 27 of the case assembly 20. A ramp 83 on the underside of the cam arm 81 exists to the right (in relation to FIG. 1's perspective) of a mounting hole 82. A side arm 84 and hook 85 exists to the left of the mounting hole 82. When the guardbolt assembly 80 moves from a retracted to an extended position, one of the tab ramps 74 or 75 engages the ramp 83 of the cam arm 81, causing the right portion of the cam arm 81 to pivot upward, and the left portion to pivot downward. When the guardbolt assembly 80 moves from an extended to a retracted position—as would occur when a person shut the door—blocker spring 87 biases the cam arm 81 to pivot clockwise. As the left portion of the cam arm 81 is pivoted upward, the hook 85 (see FIGS. 8-9) obstructs the path of the tail plate 56 of the latchbolt assembly 50, preventing its retraction.

Two mechanisms are provided to overcome the spring-biased blocking position of the cam arm 81. First, rotation of the latch retractor assembly 40 (a consequence of turning a door handle) causes the blocker engagement arm 46 of the operating lever 45 to engage the side arm 84. Second, turning a key in the keyed cylinder 98 to a fully unlocked position drives the latch retractor 48 clockwise, causing the head portion 49 to engage the side arm 84. Both mechanisms push the left portion of the cam arm 81 downward and the hook 85 outside of the path of the tail plate 56.

Springs 87 and 88 are mounted on bushing 86. The guardbolt spring 88 biases the guardbolt assembly 70 into the extended position. The blocker spring 87 biases the cam arm 81 into a blocking position.

The deadbolt assembly 15 comprises a deadbolt 16, a deadbolt stop 17, and a deadbolt tailpiece 18. A bolt portion 16 moves between a deadbolt retracted position, where it is disposed within the housing, and a deadbolt extended position, where it protrudes through deadbolt openings 91 in the front plates 90 and 95. As the bolt portion 16 moves into its extended position, a deadbolt stop 17 comes into contact with post 25, which functions as a housing stop that restrains further outward movement past the deadbolt extended position.

II. New Easily Reversibly Handed Clutch Mechanism

Figure 5:
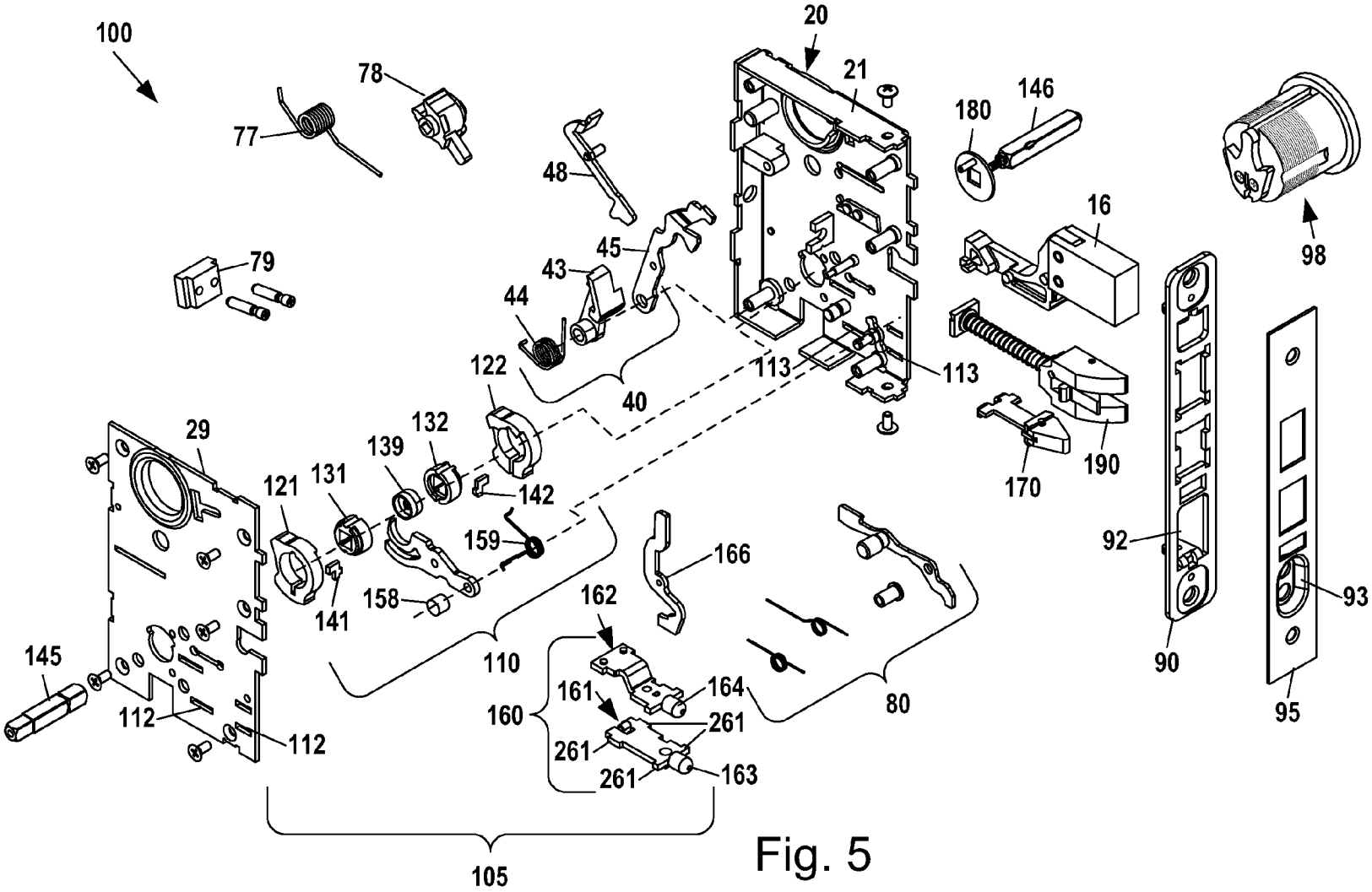
FIG. 5 is an exploded view diagram of one embodiment, containing a deadbolt and a finger-operable outside-door-handle coupling and decoupling assembly, of a new mortise lockset according to the present invention.
Figure 6:
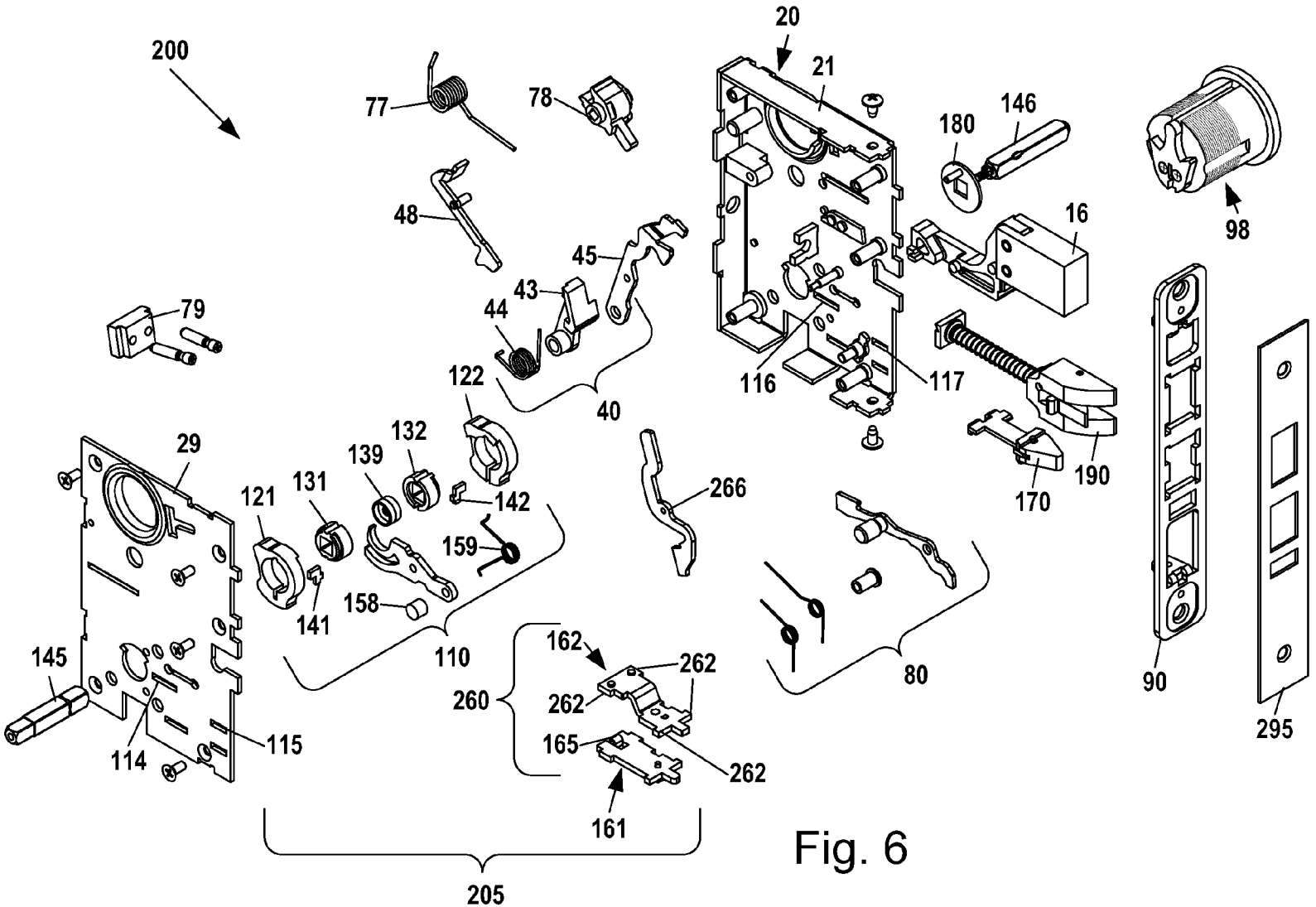
FIG. 6 is an exploded view diagram of another embodiment, containing a deadbolt but omitting the hand-operated buttons for selectively coupling and decoupling the outside door handle, of a new mortise lockset according to the present invention.
Figure 7:
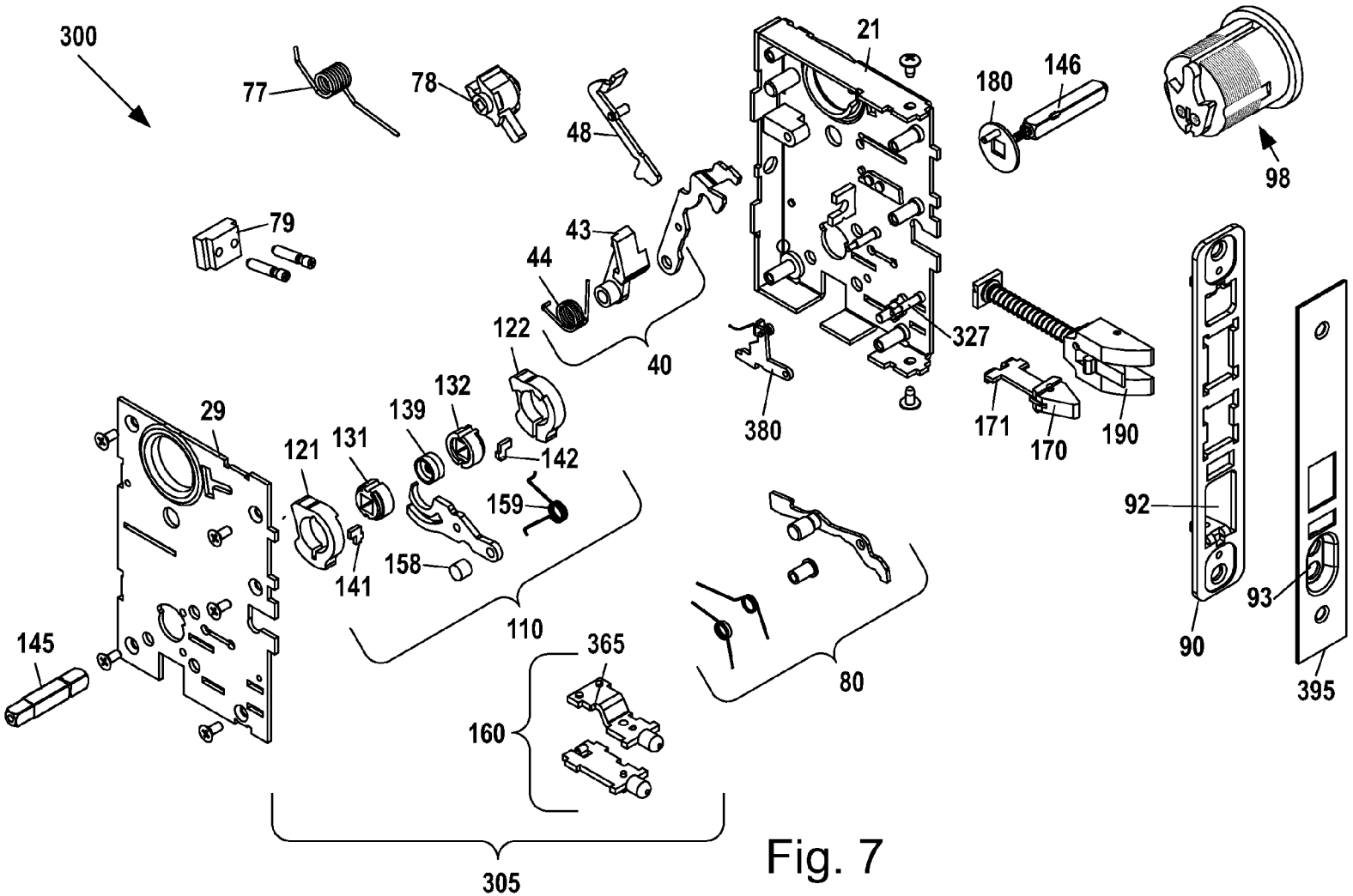
FIG. 7 is an exploded view diagram of yet another embodiment, omitting the deadbolt but retaining the finger-operable outside-door-handle coupling and decoupling assembly, of a new mortise lockset according to the present invention.

FIGS. 5-7 illustrate exploded views of new mortise locksets 100, 200, and 300 with an easily reversibly handed clutch mechanism 105, 205, or 305 for selectively engaging or disengaging the outside door handle from the principal latch retractor assembly 40. The new mortise locksets 100, 200, and 300 have many of the same components as those shown in prior art mortise lockset 10. Elements that the new mortise locksets 100, 200, and 300 have in common with the prior art mortise lockset 10 of FIGS. 1-4*b* are illustrated with the same reference numbers. New or modified elements in the new mortise locksets 100, 200, and 300 are illustrated with new reference numbers.

FIGS. 5-7 illustrate different mortise lockset embodiments that include one or more of the inventive elements of the present invention. FIG. 5 illustrates a mortise lockset 100 with a clutch actuator assembly or clutchworks 160 that is operated either by throwing the deadbolt 16 or by a user activating a finger-operable arrangement that is accessible via recess 93 in faceplate 95. FIG. 6 illustrates a very similar mortise lockset 200, but it lacks the finger-operable arrangement shown in FIG. 5. In FIG. 6, clutchworks 260 is operated solely by extending or retracting the deadbolt 16. Moreover, retraction of the deadbolt assembly 15 not only drives the lever 266 in reverse, but also forcibly engages the clutchworks 260. The lever 166 of FIG. 5 is like the lever 266 of FIG. 6, but its bottom is cut off, so retraction of the deadbolt assembly 15 simply moves the lever 166 out of the way, allowing a person to operate button 163 to engage the clutchworks 160. FIG. 7 also illustrates a mortise lockset 300 similar to that of FIG. 5, but it lacks the deadbolt 16.

Figure 13:
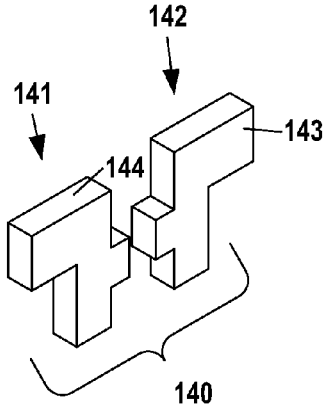
FIG. 13 is an exploded view diagram of the clutch links of the clutch of FIGS. 5-7.
Figure 14:
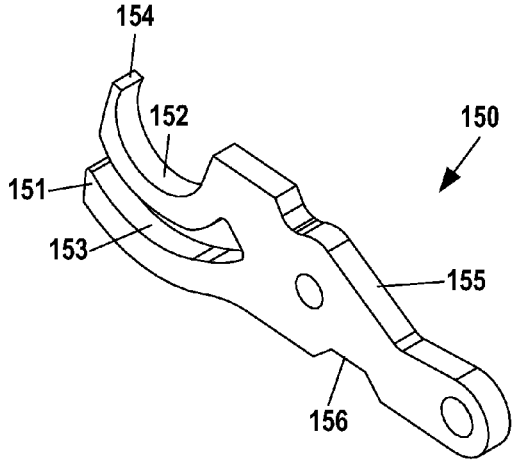
FIG. 14 is a perspective view of the pivotally mounted lever arm of the clutch of FIGS. 5-7.
Figure 15:
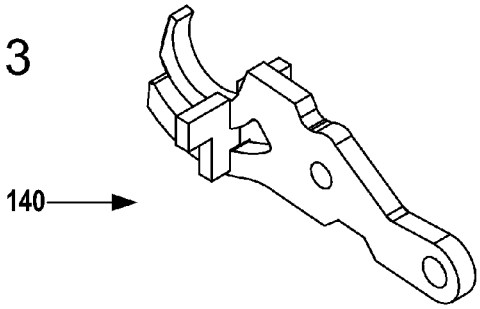
FIG. 15 is a perspective view of the clutch links carried by the pivotally-mounted lever arm.
Figure 16:
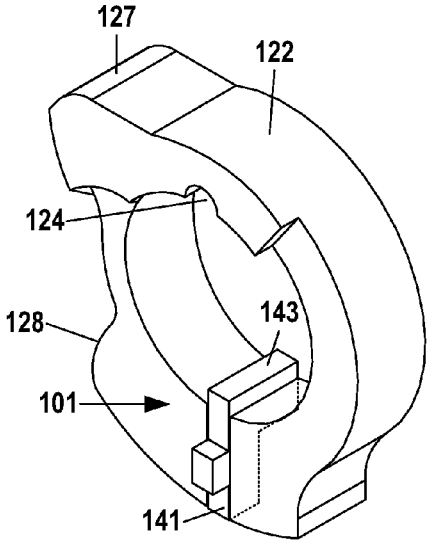
FIG. 16 is a perspective view of one of the clutch links seated, in a hub-coupling position, in one of the outer hubs.
Figure 17:
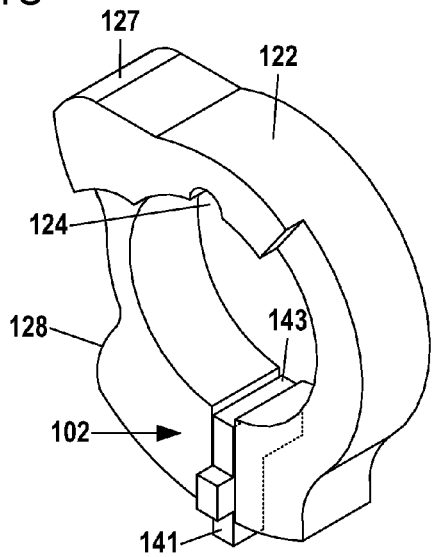
FIG. 17 is a perspective view of the clutch links of FIG. 16 seated, in a hub-decoupling position, in the same outer hub.
Figure 18:
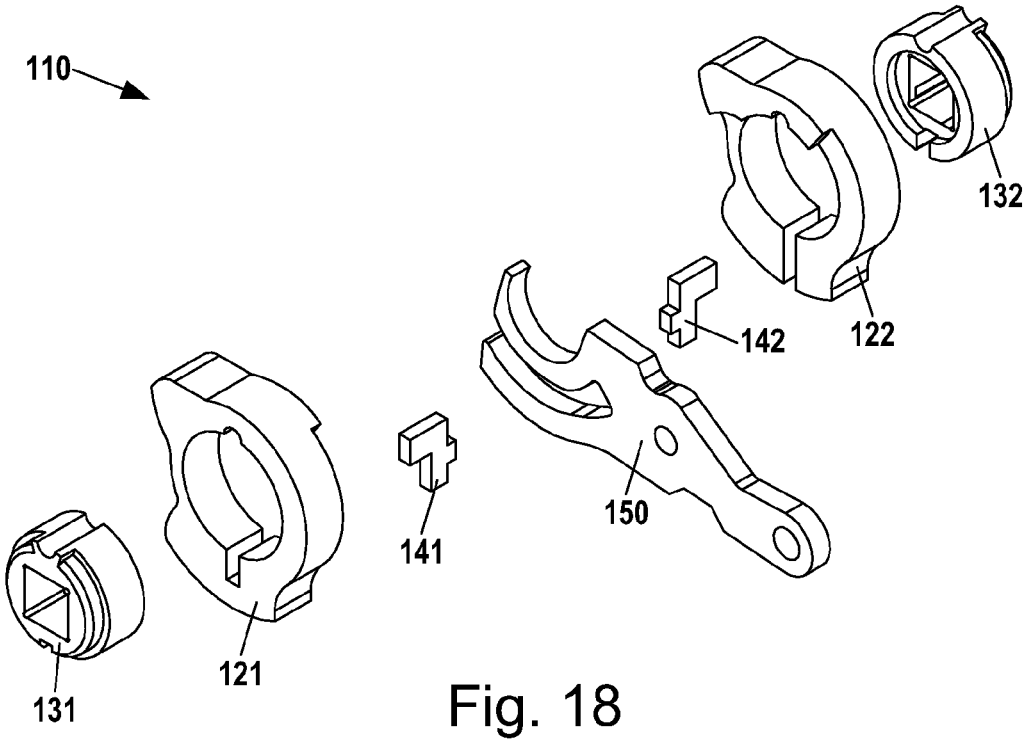
FIG. 18 is an exploded view of the non-handed clutching hub assembly of FIGS. 5-7.

Each clutch mechanism 105, 205, and 305 comprises a non-handed clutching hub assembly 110 (shown in enlarged detail in FIG. 18) actuated by a clutchworks 160 or 260. Each clutch mechanism 105, 205, or 305 also includes a lock-handing selector 180, described further below, that sets the handing of the clutch mechanism 105, 205, or 305. The non-handed clutching hub assembly 110 comprises an outer coaxial cam hub subassembly 120, an inner spindle hub subassembly 130, a hub separator or bushing 139 (FIGS. 5-7), and a clutch 140 (FIG. 13).

The coaxial cam subassembly 120 (enlarged in FIG. 10) preferably comprises a pair of exterior operating cams 121 and 122—which may also be referred to as outer hubs. The first and second operating cams 121 and 122 are mirror images of each other, and each have divaricate cam projections 127 and 128 (also referred to herein as latch-retracting actuating portions) adapted—when rotated in either direction—to drive the biasing lever 43 backwards to retract the latch. Although in the illustrated embodiments, the first and second operating cams are independently rotatable, they can, in an alternative embodiment not shown, be permanently coupled together. Indeed, the coaxial cam subassembly 120 may optionally consist of a one-piece hub.

Figure 23:
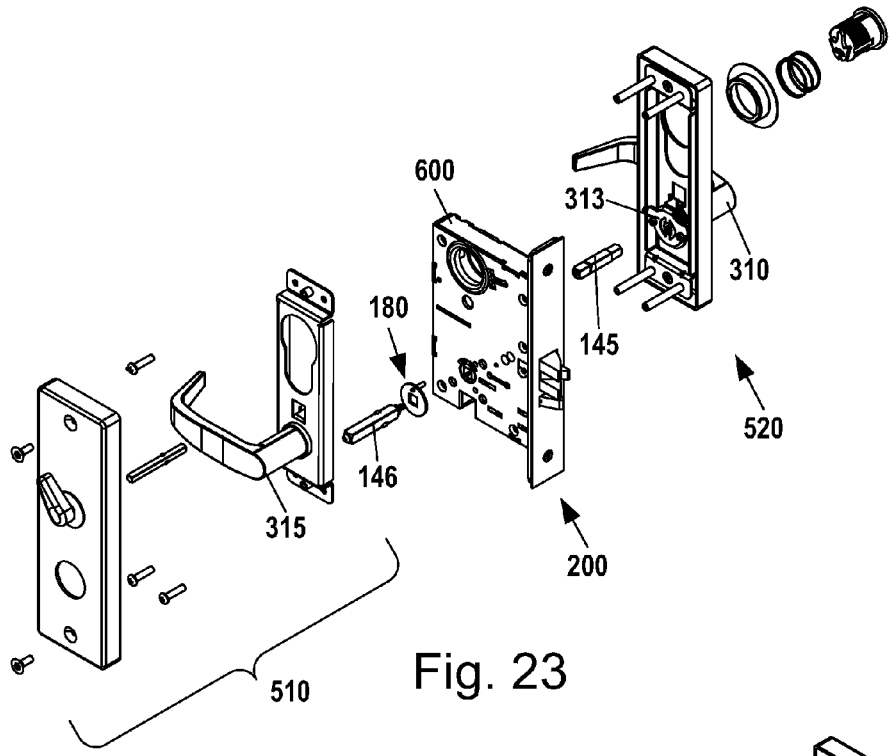
FIG. 23 is a perspective view of the lockset of FIG. 6, together with outer and inner trim, with the lock-handing selector about to be inserted into the left-hand side of the lockset for installation on a left-handed door.
Figure 24:
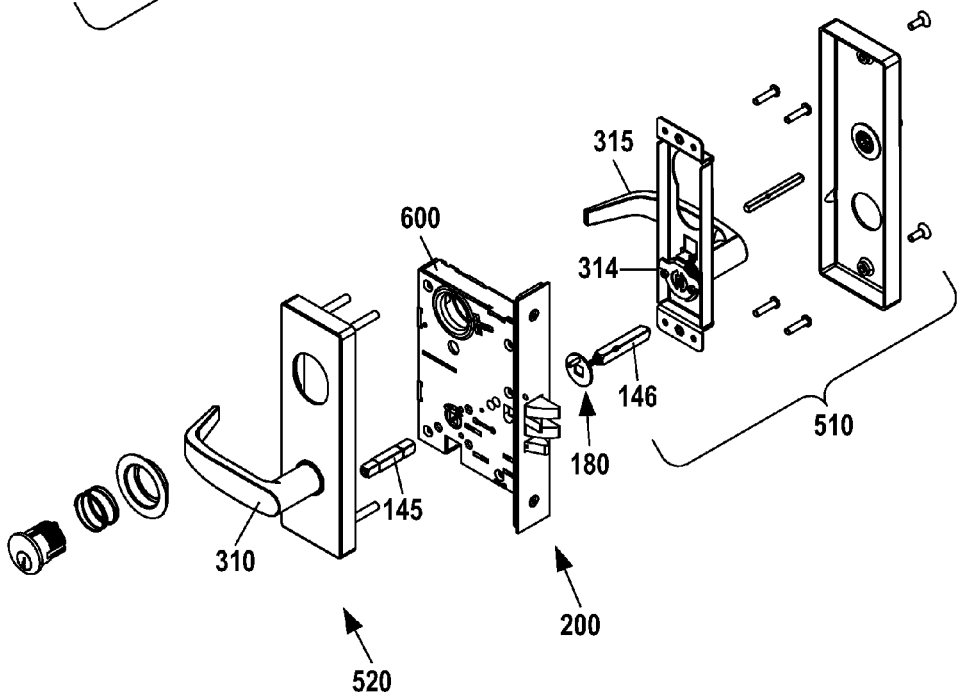
FIG. 24 is a perspective view of the lockset of FIG. 6, together with outer and inner trim, with the lock-handing selector about to be inserted into the right-hand side of the lockset for installation on a right-handed door.

The inner hub subassembly 130 (enlarged in FIG. 11) is preferably comprised of a pair of spindle hubs 131 and 132, which are sometimes referred to as inner hubs or interior operating cams. The spindle hubs 131 and 132 are minor images of each other. They are coaxial with and nested within the outer coaxial cam hub subassembly 120. Each spindle hub 131 and 132 is mounted on and operated by a spindle 145 or 146 that is coupled to an outside door handle 310 or an inside door handle 315 (FIGS. 23 & 24). Also, each spindle hub 131 and 132 is independently rotatable and independently interlockable with the outer coaxial cam hub subassembly 120.

The spindle hubs 131 and 132 each have a generally cylindrical exterior comprising a journaled shelf portion 137 sized for rotation in one of journal apertures 13 and 14 and a slightly larger cylindrical portion 138 having a diameter approximately equal to the diameter of an interior cylindrical cavity of one of the operating cams 121 or 122. Each spindle hub 131 and 132 has a generally rectangular cavity for receiving the spindle 145 or 146.

In the preferred embodiments, a lock-handing selector 180 is mounted coaxially with one of the spindles 145 or 146 to set the handing of the clutch mechanism 105. Depending on which side of the lock body it is installed in—the lock-handing selector 180 couples either spindle hub 131 or spindle hub 132, but not both, with one of the operating cams 121 or 122 of the coaxial cam subassembly 120.

Figure 12:
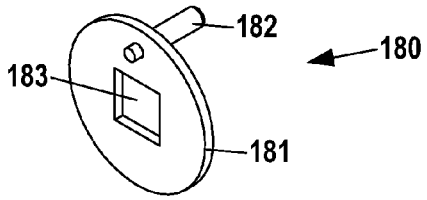
FIG. 12 is a perspective view of the lock-handing selector of FIGS. 5-7.
Figure 19:
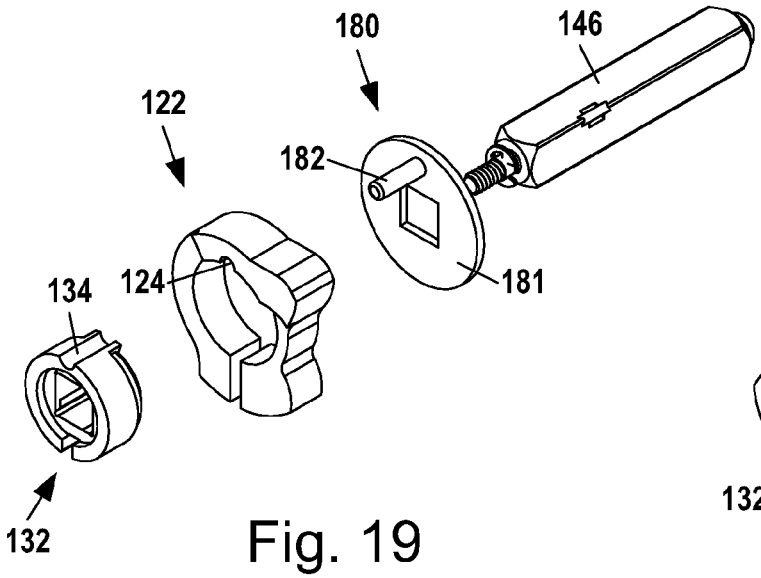
FIG. 19 is an exploded view showing how the lock-handing selector of FIGS. 5-7 interacts with one of the pairs of outer and inner hubs.
Figure 20:
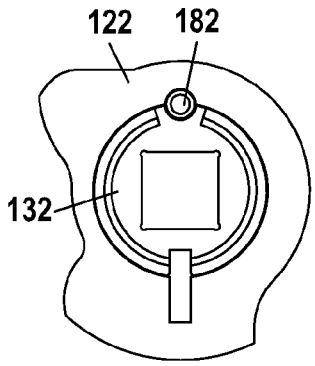
FIG. 20 is a front view of the lock-handing selector inserted into and regularly coupling an assembled pair of hubs.

As depicted more clearly in FIGS. 12 and 19, the lock-handing selector 180 comprises a pin 182 that is staked on a torque washer 181. The square hole 183 in the torque washer 181 is sized to mount on, and turn with, spindle 145 or 146. As best illustrated in FIGS. 19 and 20, the pin 182 is sized to fit into either of two circular slots formed by pairs of corresponding grooves in the inner and outer hub subassemblies 120 and 130. Operating cam 121 and spindle hub 131 have corresponding semicylindrical grooves 123 and 133 (see FIGS. 10-11) that, upon receiving the pin 182 of the lock-handing selector 180, couple the operating cam 121 and spindle hub 131 together. Likewise, operating cam 122 and spindle hub 132 have corresponding semicylindrical grooves 124 and 134 that, after receiving the pin 182 of the lock-handing selector 180, couple the operating cam 122 and spindle hub 132 together. When the lock-handing selector 180 is mounted on spindle 145 or 146, the pin 182 only extends far enough to fill one of the two circular slots.

To ensure that the inside door handle is always coupled to the latch retractor assembly 40, the lock-handing selector 180 is mounted on the spindle associated with the inside door handle. Because the lock-handing selector 180 is spindle-mounted, it can—advantageously—be removed from one side of the lock body and replaced on the other side while the lock body is still installed in the mortise. Also, if an installer does not wish to have the inside door handle regularly coupled to the latch retractor assembly 40 (such as might be required for an "asylum lock"), the installer simply chooses not to install the lock-handing selector 180 on either spindle. At the opposite extreme, lock-handing selectors 180 could be mounted on both spindles at the same time, making both door handles regularly coupled to the latch retractor assembly 40.

A non-handed clutch 140 (FIG. 15) is provided to selectively decouple the spindle hub 131 or 132 associated with the outside door handle from the coaxial cam subassembly 120. Indeed, clutch 140 is operable to couple or decouple any pair of corresponding hubs 121 and 131 or 122 and 132 that is not regularly coupled together by the lock-handing selector 180. Clutch 140, best illustrated in FIG. 15, comprises two displaceable clutch links, keys, or dog members 141 and 142 carried in a pivotally mounted lever arm 150. The clutch 140 also comprises a lever arm spring 159 (FIGS. 5-7) biasing the lever arm 150 into a clutch-engaged position, and a lever arm bushing 158.

The pivotally-mounted lever arm 150 moves the clutch links 141 and 142 between a hub-coupling position 101 (FIGS. 8, 16, 28-30) and a non-hub-coupling position 102 (FIG. 9, 17, 31-33). Although the embodiments depicted in the drawings show separate clutch links 141 and 142, so that the door handles turn independently, optional embodiments of the clutch, not shown, have a unitary clutch link or dog.

Figure 10:
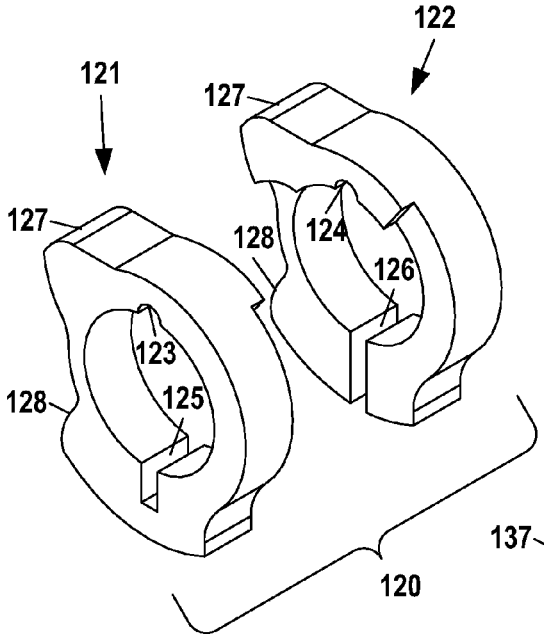
FIG. 10 is an exploded view diagram of the outer hub or coaxial cam subassembly of FIGS. 5-7.
Figure 11:
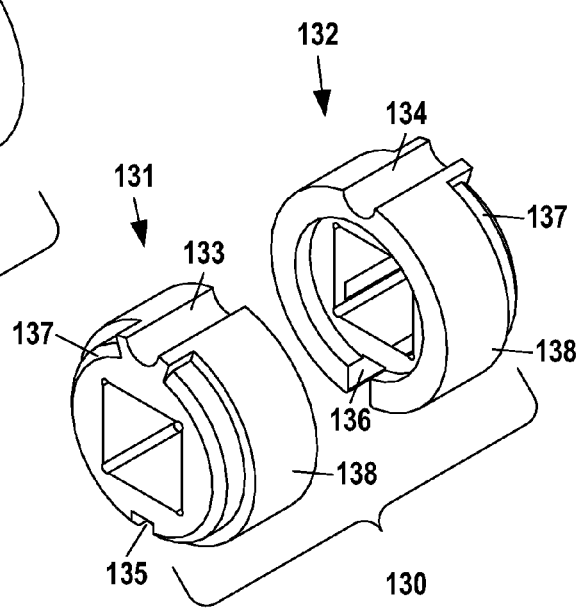
FIG. 11 is an exploded view diagram of the inner hub subassembly of FIGS. 5-7.

Clutch links 141 and 142 are carried by the lever arm 150 to slide vertically within rectilinear upside-down-L-shaped slots 125 and 126 disposed opposite the semicircular grooves 123 and 124 along the inside cylindrical cavities of operating cams 121 and 122 (FIG. 10). In the hub-coupling position 101, shoulders 143 and 144 of clutch links 141 and 142 protrude out of their slots 125 and 126 in the operating cams 121 and 122 (see FIG. 16) and come into coupling engagement with corresponding rectilinear slots 135 and 136 in spindle hubs 131 and 132 (see FIG. 11), coupling the hubs together. Slots 135 and 136 are disposed along the outside cylindrical surfaces 138 of spindle hubs 131 and 132, opposite semicircular grooves 133 and 134. In the non-hub-coupling position 102, the shoulders 143 and 144 are completely recessed within slots 125 and 126 (see FIG. 17), freeing any spindle hub 131 or 132 not otherwise coupled by the lock-handing selector 180 to the coaxial cam subassembly 120 to rotate independently of the coaxial cam subassembly 120.

Because the clutch links 141 and 142 are recessed in slots 125 and 126, rotation of the coaxial cam subassembly 120 also rotates the clutch links 141 and 142 along an orbit around the spindle axis. To accommodate this orbit, the clutch links 141 and 142 are carried within a radial guide or slot 153, between two arcuate prongs 151 and 152, of the lever arm 150 (see FIG. 14). Arcuate prong 152 has an arcuate inside edge that, when the lever arm 150 is in the hub-coupling position 101, engages the hub separator 139. When the lever arm 150 is in the non-hub-coupling position 102, the distal upturned end 154 of the arcuate prong 152 remains positioned between the two outer operating cams 121 and 122—thereby preventing the lever arm 150 from getting caught on an outside edge of one of the operating cams 121 and 122.

A clutchworks 160 or 260 (FIGS. 5-7) is provided to switch the lever arm 150 between a hub-coupling position 101 and a non-hub-coupling position 102. The clutchworks 160 or 260 comprises interconnected slides 161 and 162 that are configured much like and geared together like the locking slides 61 and 62 of FIG. 1. In FIGS. 5 and 7, the clutchworks 160 also incorporates a finger-operable, faceplate-accessible arrangement comprising two buttons 163 and 164 mounted on slides 161 and 162, respectively. The finger-operable arrangement may alternatively comprise a different mechanism, such as a rocker assembly (not shown), an example of which is illustrated in U.S. Pat. No. 4,695,082, which is herein incorporated by reference. In FIG. 6, the clutchworks 260 simply comprises the slides 161 and 162, without the buttons 163 and 164.

The lower slide 161 has lateral tabs 261 configured to mount and slide horizontally in slots 112 and 113 (FIG. 5) of the cover 29 and case assembly 20, respectively. The upper slide 162 has lateral tabs 262 configured to mount and slide horizontally in slots 114, 115, 116, and 117 (FIG. 6) of the cover 29 and case assembly 20.

Figure 31:
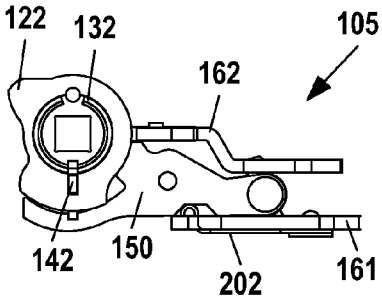
FIG. 31 is a side view of the clutch mechanism of FIGS. 5-7, with the clutch and clutchworks in a hub-decoupling position.
Figure 32:
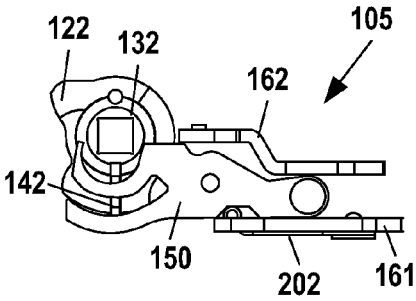
FIG. 32 is a partially cut-away side view of FIG. 31, showing the position of the pivotally mounted lever arm.
Figure 33:
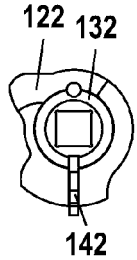
FIG. 33 illustrates the position of the clutch link within the decoupled but aligned hubs of FIG. 31.
Figure 34A:
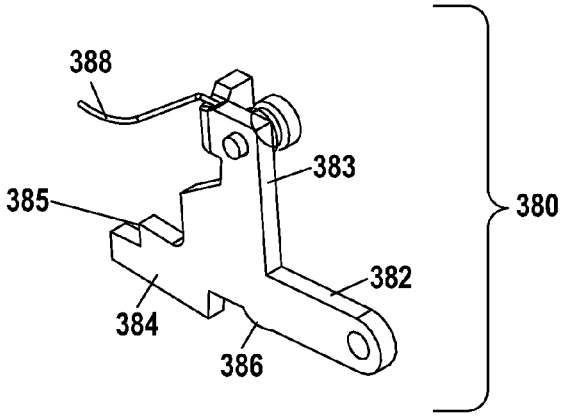
FIGS. 34*a*-34*f* provide different views of the pivoted blocker assembly of FIG. 7, including a spring.
Figure 34B:
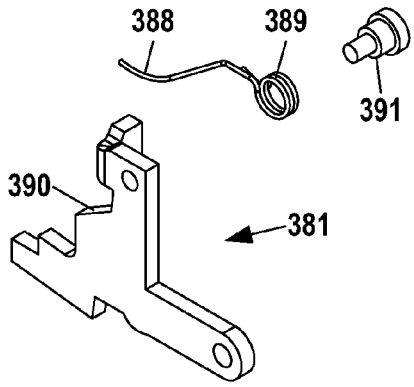
Figure 34C:
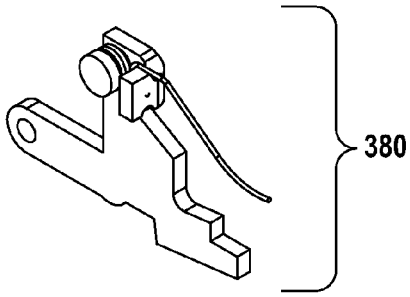
Figure 34D:
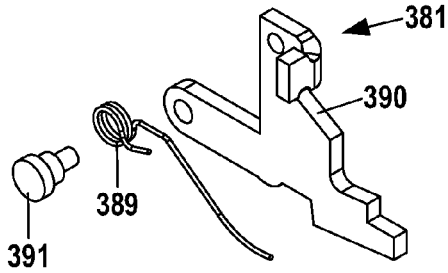
Figure 34E:
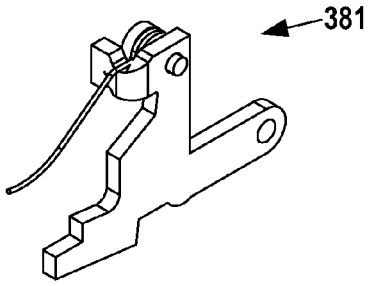
Figure 34F:
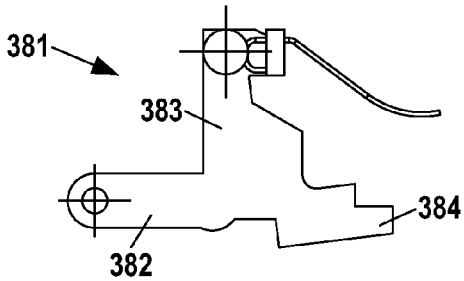

To disengage the outside door operating cam 122, the upper slide 162 is driven forward (that is, to the left, from the perspective of FIGS. 5-7), causing it to engage a ramp 155 (FIG. 14) provided on the upper edge of the lever arm 150, thereby forcing the lever arm 150 to pivot downward. When the upper slide 162 is driven forward, a detent 165 on the lower slide 161 is received within a notch 156 provided on the bottom edge of the lever arm 150, as shown in FIGS. 31-33. The non-hub-coupling position 102 of the clutch 140 is illustrated in FIGS. 9, 17, and 31-33.

To re-engage the outside door operating cam 122, the lower slide 161 is driven forward, forcing the detent 165 (FIG. 25) out of the notch 156, and causing the detent 165 to press the lever arm 150 upward. The hub-coupling position 101 is illustrated in FIGS. 8, 16, and 28-30.

Each clutching mortise lockset 100, 200, and 300 preferably includes a guardbolt 170 with a double slanted-face that can be triggered in either direction. Because the guardbolt 170 can be triggered in either direction, there is no need to remove and rotate the guardbolt 170 to adapt the mortise locksets 100, 200, and 300 from a left-handed configuration to a right-handed configuration, or vice-versa.

Each clutching mortise lockset 100, 200, and 300 also preferably includes a reversible handing latchbolt assembly 190. With a reversible handing latchbolt assembly 190, the cover 21 does not have to be removed from the case 21 to reverse the handing of the latchbolt assembly 190. Indeed, in the preferred embodiment, neither of the faceplates 90 or 95 have to be removed either. Rather, the latchbolt 191 is either decoupled from the latchbolt stem 193, or super-extended out of the faceplates 90 and 95, and then rotated 180 degrees and replaced. Examples of reversible handing latchbolts can be found in GB 2150631, which is herein incorporated by reference, and other references.

Advantageously, the clutching mortise locksets 100, 200, and 300 can all be adapted from a left-handed to a right-handed adaptation, or vice versa, without removing the front plates 90, 95, 295, and/or 395 (see FIGS. 5-7), without opening the lock body (i.e., without removing the cover 29 from the case 21), and while the lock body is installed in the mortise of a door.

Figure 21:
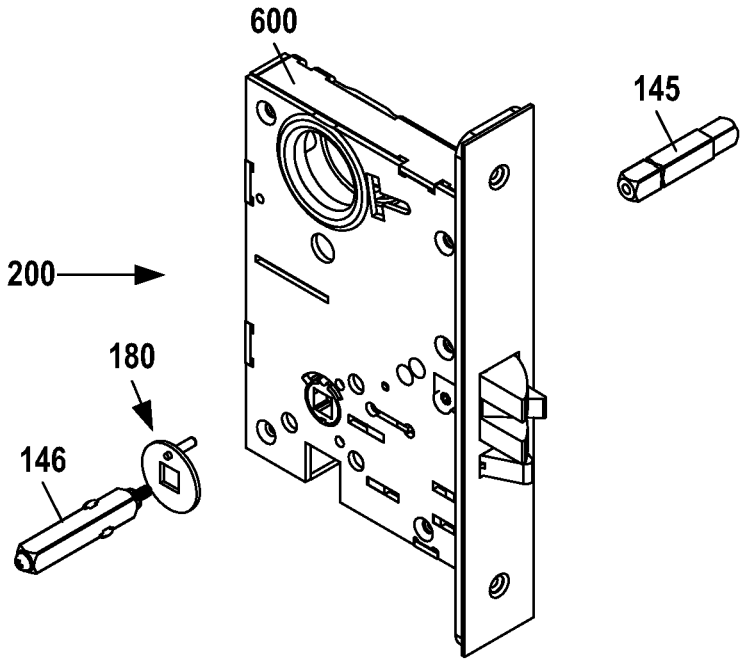
FIG. 21 is a perspective view of the lockset of FIG. 6 with the lock-handing selector about to be inserted into the left-hand side of the lockset for installation on a left-handed door.
Figure 22:
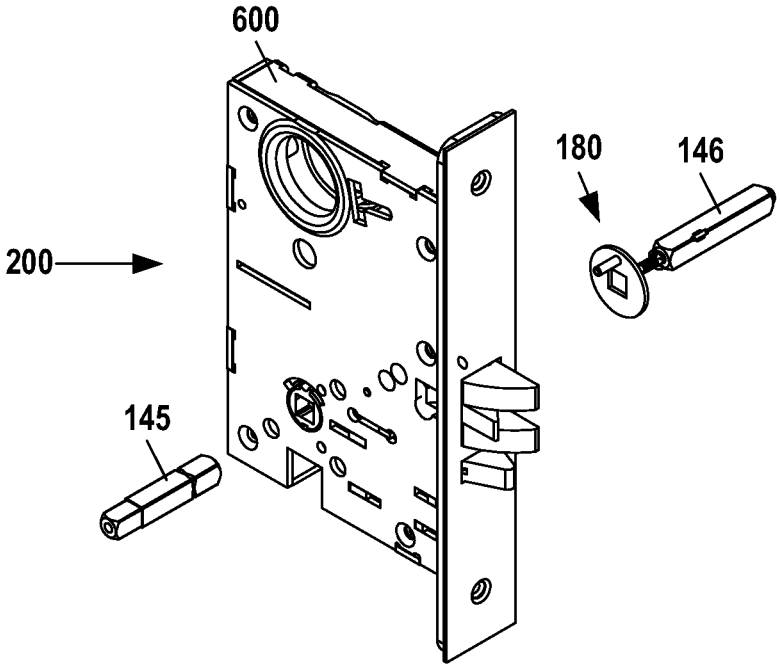
FIG. 22 is a perspective view of the lockset of FIG. 6 with the lock-handing selector about to be inserted into the right-hand side of the lockset for installation on a right-handed door.

FIGS. 21-24 illustrate the ease with which this can be done. FIGS. 23 and 24 provide perspective views of the mortise lockset 200 of FIG. 6, together with an inner trim set 510 and an outer trim set 520. FIGS. 21 and 23 show the lock-handing selector 180 about to be inserted into the left-hand side of the lockset 200 for installation on a left-handed door. FIGS. 22 and 24 show the lock-handing selector 180 about to be inserted into the right-hand side of the lockset 200 for installation on a right-handed door. Changing the handing of the lockset 200 is as easy as switching the trim sets 510 and 520 around. Removing the trim sets 510 and 520 provides easy access to the lock-handing selector 180, which can then be removed from one side of the lock body 600 and replaced on the other side—and all the while the lock body 600 is installed in the door mortise.

III. New Escapement Mechanism for a Clutching Mortise Lockset

Figure 25:
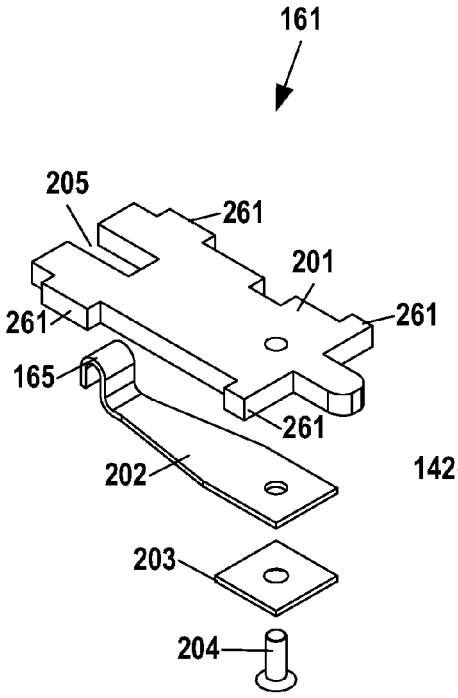
FIG. 25 is an exploded view diagram of the lower slide of the faceplate-accessible clutchworks of FIGS. 5-7, illustrating a new escapement mechanism.

As best illustrated in FIGS. 25-33, the lower slide 161 has an escapement mechanism that allows the lower slide 161 to be driven forward in a manner that urges or biases, but does not necessarily force, the lever arm 150 into the hub-coupling position 101. FIG. 25 illustrates an exploded view diagram of the lower slide 161.

As shown in FIG. 25, the lower slide 161 comprises a plate 201, a leaf spring 202, a square washer 203, and a fastener 204. The plate 201 has a slot 205 for receiving the detent 165, which is mounted on leaf spring 202.

Figure 26:
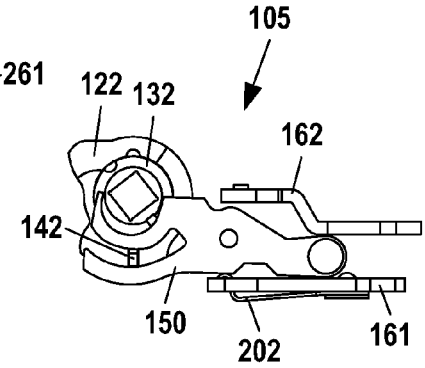
FIG. 26 is a partially cut-away side view of the clutch mechanism of FIGS. 5-7, with the clutch in a hub-decoupled position but with the clutchworks positioned to bias the clutch lever arm toward a hub-coupling position.
Figure 27:
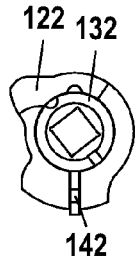
FIG. 27 illustrates the position of the clutch link within the disengaged and non-aligned hubs of FIG. 26.

This leaf-spring-based escapement mechanism allows a person to drive the lower slide 161 forward, for the purpose of coupling the hubs, even when—as illustrated in FIG. 26—the outside-door-handle spindle hub 131 or 132 is not aligned with the coaxial cam subassembly 120. This may occur, for example, when someone attempts to engage the button 163 (FIGS. 5 & 7) or other finger-operable arrangement associated with the lower slide 161—in order to couple the outside door handle to the latch retractor assembly 40—while torquing the inside door handle to a latch-retracting position. In this position—illustrated in FIGS. 26 and 27—the lever arm 150 cannot force the clutch 140 into the slots 135, 136 of the inner hub subassembly 130, because the slots 135, 136 are not aligned with the corresponding slots 125, 126 of the coaxial cam subassembly 120. The escapement mechanism nevertheless allows the person to push the lower slide 161 forward, depressing the leaf spring 202.

Figure 28:
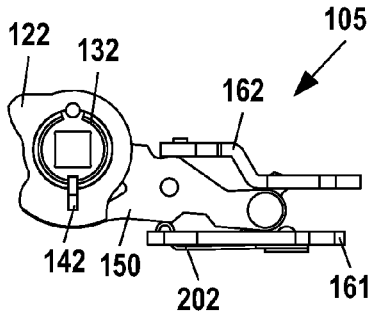
FIG. 28 is a side view of the clutch mechanism of FIGS. 5-7, with a clutch link biased toward and positioned in a hub-coupling position.
Figure 29:
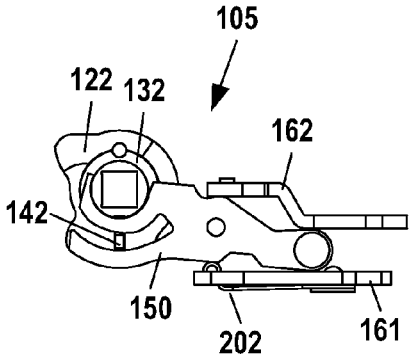
FIG. 29 is a partially cut-away side view of FIG. 28, showing the position of the pivotally mounted lever arm.
Figure 30:
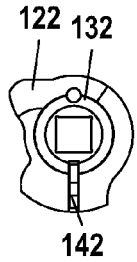
FIG. 30 illustrates the position of the clutch link within the engaged hubs of FIG. 28.

When the person releases the door handle, various default-positioning devices essentially "snap" the lever arm 150 into place. First, torsion springs 313 and 314 (FIGS. 23-24) bias the spindle hubs 131 and 132 into a default "centered" position. Second, biasing spring 44 biases the biasing lever 43, and in turn the divaricate cam projections 127 and 128 of the coaxial cam subassembly 120, into a default orientation that re-aligns the coaxial cam subassembly 120 with the inner hub subassembly 130. Once re-aligned, the leaf spring 202 rotates the lever arm 150 up into the hub-coupling position 101, as illustrated in FIGS. 28-30.

FIGS. 31 and 32 illustrate the lower slide 161 in a spring-disabling position. In this position, the detent 165 is received in a notch 156 provided on the bottom edge of the lever arm 150. In this manner, the lower slide 161 is operative between a spring-enabling position and a spring-disabling position, wherein in the spring-enabling position, the spring 202 is positioned to bias the lever 150, and in turn the clutch 140, toward the hub-coupling position 101, and wherein in the spring-disabling position, the spring 202 is not positioned to bias the lever 150, and in turn the clutch 140, toward the hub-coupling position 101.

IV. New Guardbolt Blocker Assembly for a Clutching or Locking Mortise Lockset

Figure 1:
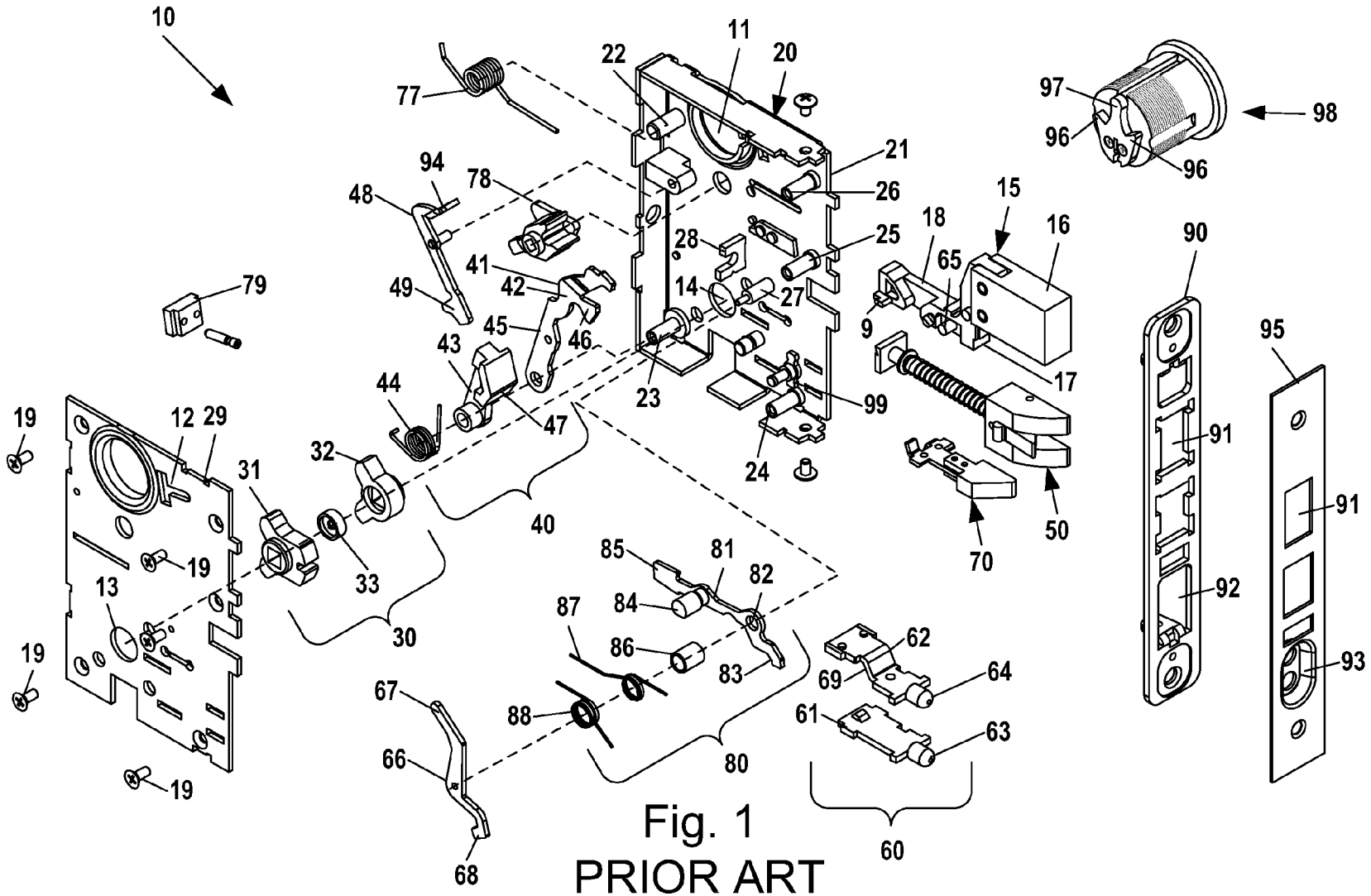
Fig. 1 PRIOR ART
FIG. 1 illustrates a prior art mortise lockset.
Figure 2A:
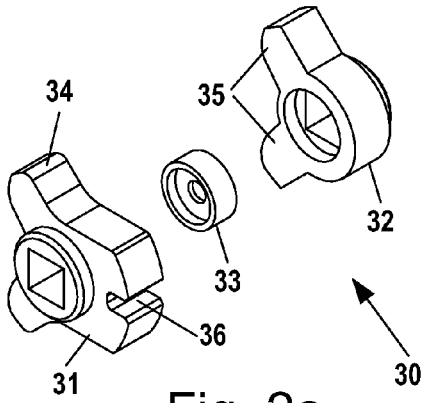
FIGS. 2*a* and 2*b* illustrate a handed locking hub assembly of the prior art mortise lockset of FIG. 1 that must be dismounted, flipped around, and remounted in the mortise lock body to reverse the handing of the lock.
Figure 2B:
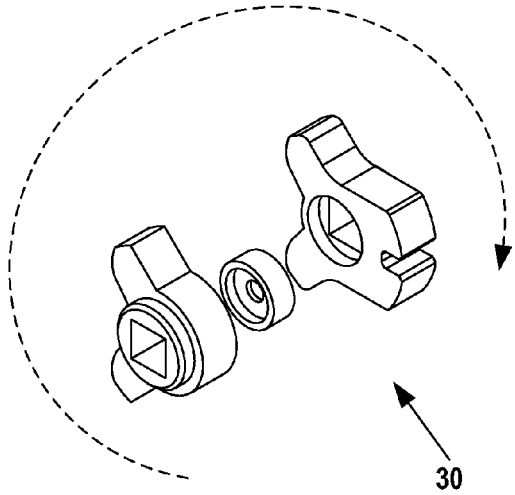

The mortise lockset illustrated in FIG. 1 includes a guardbolt 71, which is driven into a retracted position when the door is shut, to prevent an intruder from "loiding" the latchbolt 51 open. One of the tab ramps 74 and 75 of the retracted guardbolt assembly 70 engages a blocker assembly 80 that blocks the latchbolt assembly 50 from retracting. However, the blocker assembly 80 is disabled if the outside door handle is operable and operated to retract the latchbolt assembly 50. If the lockset also includes a finger-operable arrangement 63 and 64 in the front plate 95 for restoring the outside door handle to an operating condition, there is a danger—particularly with non-deadbolted mortise locks installed in left- or right-handed "reverse" doors (where the door swings out of the access-restricted space)—that an intruder could "card" the finger operable arrangement 63 and 64 in order to unlock or clutch the outside door handle and thereby disable the blocker assembly 80.

Figure 37:
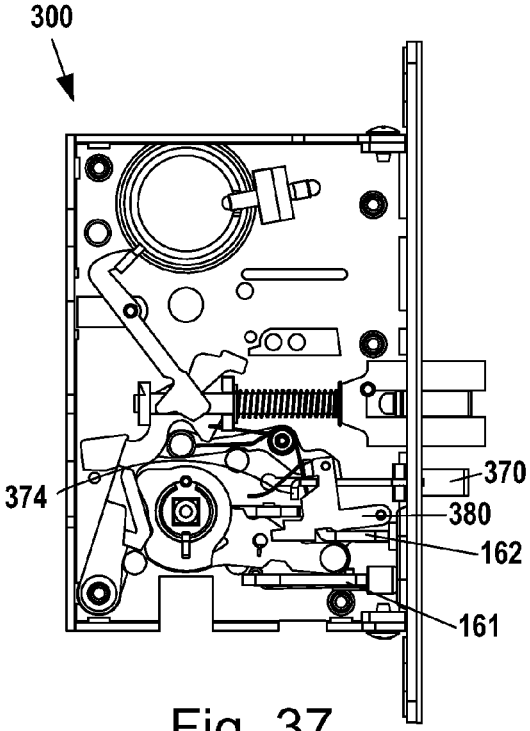
FIG. 37 is a further partially cut-away side view of the mortise lockset of FIG. 7, showing the guardbolt in an extended position, the hub clutching assembly in a hub-coupling position, and the blocker assembly in a non-blocking position.
Figure 38:
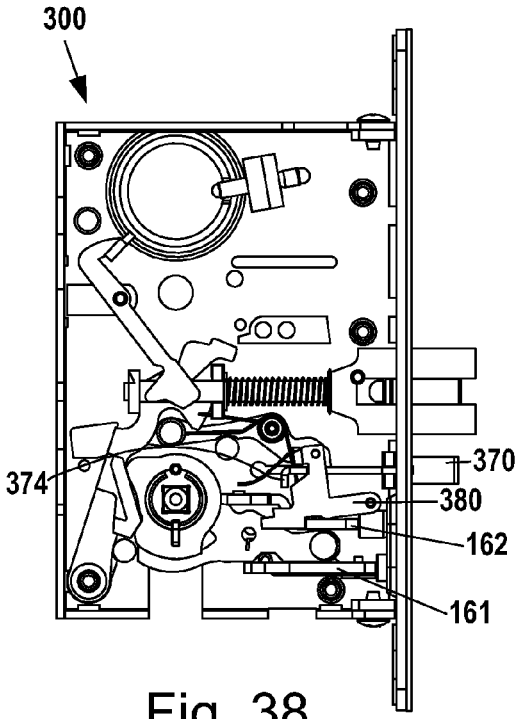
FIG. 38 is yet another partially cut-away side view of the mortise lockset of FIG. 7, showing the guardbolt in an extended position, the hub clutching assembly in a hub-coupling position, and the blocker assembly in a non-blocking position.
Figure 39:
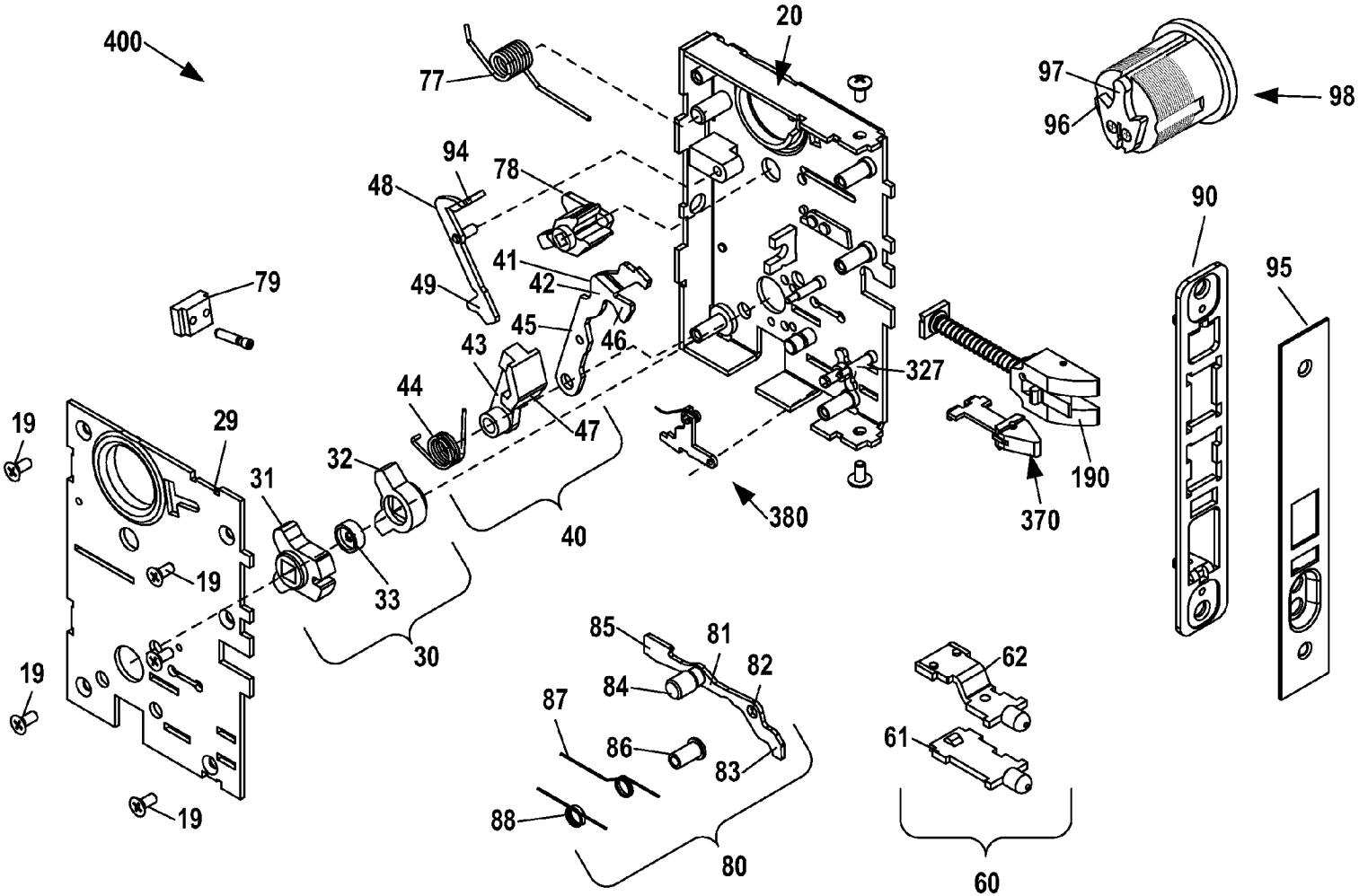
FIG. 39 is an exploded view diagram of a mortise lockset with a locking—as opposed to clutching—hub assembly, but advantageously using the pivoted blocker assembly of FIG. 34.

FIGS. 7 and 34-39 illustrate an improved blocker assembly 380 that prevents an intruder from "loiding" a mortise lock outdoor-handle-disabling works (e.g., a "stop works" or "clutch works") into an outside-door-handle-operating condition. FIG. 7 illustrates the improved pivoted blocker assembly 380 installed in a clutching mortise lockset 300. FIG. 39 illustrates the improved pivoted blocker assembly 380 installed in a locking mortise lockset 400.

FIGS. 34*a*-34*f* provide enlarged perspective, exploded, and facing views of the pivoted blocker assembly 380. Pivoted blocker assembly 380 comprises a spring 389 mounted, via pin 391, on a blocking dog 381. The blocking dog 381 includes a pivot arm 382 that is pivotally mounted on pivot pin 327 (FIG. 7) and a resting surface 386 that, when the blocker assembly 380 is disabled, rests on the upper slide. The blocking dog 381 also includes a lever arm 383 that mounts the extended arm 388 of the spring 389 in a position just over the guardbolt tab ramps 374. Finally, the blocking dog 381 includes a blocking arm 384 with a left-facing abutment 385.

Figure 36:
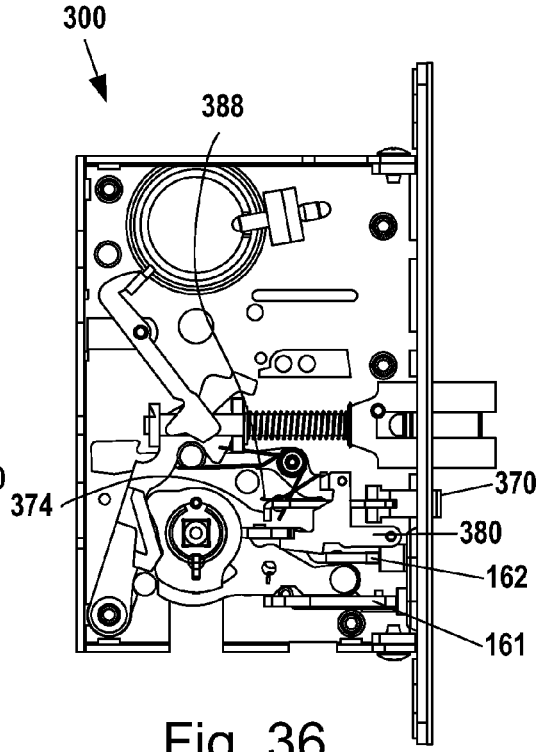
FIG. 36 is another partially cut-away side view of the mortise lockset of FIG. 7, showing the guardbolt in a retracted position, which engages the spring on the pivoted blocker assembly to pivot the blocker assembly into a position blocking movement of the hub clutching assembly from a hub-decoupling position to a hub-coupling position.

FIG. 36 illustrates the mortise lockset 300 in a shut door. Before the door was shut, the finger-operable arrangement 390 was operated to put the clutchworks 160 into a hub-decoupling position. The shutting of the door forced the guardbolt 370 into a retracted position. In that retracted position, the stem tab 374 of the guardbolt 370 presses against the extended arm 388 of the spring 389, pivoting the blocking assembly 380 upward into a blocking position. In this blocking position, the left-facing abutment 385 interferes with the path of a shoulder 365 on the upper slide 162 (FIG. 7), preventing any rearward movement. In this manner, the blocker assembly 380 blocks movement of the clutchworks 160 from a hub-decoupling position to a hub-coupling position.

Figure 35:
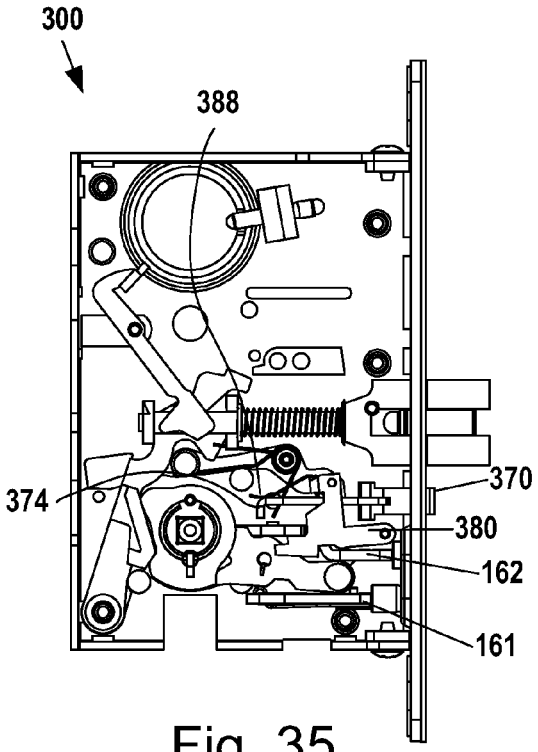
FIG. 35 is a partially cut-away side view of the mortise lockset of FIG. 7, showing the hub clutching assembly in a hub-coupling position while the guardbolt in the retracted position, with the guardbolt extension deflecting the spring of the pivoted blocker assembly.

FIGS. 35, 37 and 38 illustrate three configurations in which the blocking assembly 380 is disabled. FIG. 35 shows the clutchworks 160 in a hub-coupling position while the guardbolt in the retracted position. In this position, the stem tab 374 of the guardbolt 370 merely deflects the spring arm 388. Here, the upper slide 162 blocks the blocker assembly 380 from pivoting upward. FIGS. 37 and 38 show the guardbolt 370 in an extended position. When the guardbolt 370 in the extended position, the leading edge 171 (FIG. 7) of the guardbolt stem tab 374 comes into contact with ramp 390, driving the blocking dog 380 in a counterclockwise motion. In this disabled position, the guardbolt stem tab 374 does not even come into contact with the spring arm 388. Accordingly, there is no mechanism biasing the blocker assembly 380 into a blocking position.

The blocking assembly 380 is equally useful in a locking mortise lockset. FIG. 39 illustrates a mortise lockset 400 with the locking hub assembly 30 of FIG. 1, but which advantageously uses the pivoted blocker assembly 380 of FIG. 34.

It is the inventor's intent that the scope of any of the claims be defined by the language of the claims, and not narrowed by reference to the embodiments described in this summary, the detailed description of the invention, or to any particular need, object, or suggested solution described in this specification.

When the phrase "door handle" is used in this specification and claims, it refers to parts that are designed to be held or operated with the hand, including both traditional door knobs, lever-type door handles, and other types of door handles. When the phrases "inside outdoor handle" and "outside door handle" is used in this specification and claims, they refer to the door handles on the inside and outside, respectively, of any access-controlled space, and are not exclusive of locksets installed on doors that are inside a building.

It will be understood that the particular configurations of many of the new elements could be changed without departing from the spirit of the present invention. For example, the lock-handing selector 180 does not have to comprise a pin 182 mounted on a washer 181. Likewise, there are potentially innumerable ways to configure the coaxial cam subassembly 120, the inner hub subassembly 130, the clutch 140, the lever arm 150, the clutchworks 160, the blocker assemblies 80 and 380, all of the other components of the mortise lock, and the manner in which these different components interoperate. Also, mechanical locksets have been described in this specification. But the elements of the invention can also be used in electrical locksets and other kinds of locksets.

Having thus described exemplary embodiments of the present invention, it should be noted that the disclosures contained in FIGS. 1-39 are exemplary only, and that various other alternatives, adaptations, and modifications may be made within the scope of the present invention. Accordingly, the present invention is not limited to the specific embodiments illustrated herein, but is limited only by the following claims.

I claim:

1. A mortise lockset comprising:

a mortise lockset case configured for insertion into a door mortise;

a latchbolt enclosed at least partially within the mortise lockset case and guided for movement between positions in which the latchbolt extends out of the case and in which the latchbolt is substantially retracted within the case;

a latch retractor, enclosed within the mortise lockset case, operable to retract the latchbolt;

a hub assembly, enclosed within the mortise lockset case, operable to drive the latch retractor into a latchbolt-retracting position;

first and second handle-operated spindles each configured for selective operative engagement with the hub assembly;

a lock-handing selector configured to enable a selection of one of the first and second handle-operated spindles to operate the hub assembly to drive the latch retractor into the latchbolt-retracting position;

wherein the lock-handing selector is operable to be changed from a first configuration operatively enabling the first handle-operated spindle to retract the latchbolt to a second configuration, distinct from the first configuration, enabling the second handle-operated spindle to retract the latchbolt, and vice versa, without opening the mortise lockset case; and a faceplate-accessible access control link assembly enabling a user to manually switch between access-enabling and access-denying configurations that respectively enable and disable an opposite one of the first and second handle-operated spindles to operate the hub assembly to drive the latch retractor into the latchbolt-retracting position;

wherein the first and second door handle-operated spindles are permanently rotationally decoupled from each other so that operative rotation of either handle-operated spindle does not rotate the opposite handle-operated spindle, even when the faceplate-accessible access control link assembly is in the access-enabling configuration so that both handle-operated spindles are configured for operative movement of the hub assembly.

2. The mortise lockset of claim 1, wherein the lock-handing selector is operable to be changed from the first configuration to the second configuration, and vice-versa, without removing the mortise lockset from a door mortise in which the mortise lockset is installed.

3. The mortise lockset of claim 2, wherein the lock-handing selector is mounted on and in surface contact with one of the two selected handle-operated spindle.

4. The mortise lockset of claim 3, wherein the lock-handing selector is mounted on the selected handle-operated spindle for rotation therewith.

5. The mortise lockset of claim 1, further comprising:

a clutch, operated by the faceplate-accessible access control link assembly, enclosed within the mortise lockset case and operative between engaged and disengaged positions in accordance with a user-selectable setting; and wherein the clutch, when engaged, rotationally interlocks a non-selected one of the first and second handle-operated spindles, opposite the selected handle-operated spindle, with a latch-retracting actuating portion of the hub assembly, thereby operatively enabling the non-selected spindle to retract the latchbolt.

6. The mortise lockset of claim 5, wherein the hub assembly comprises a pair of coaxial cams, each operable to rotate, independently of the other, both counterclockwise and clockwise with respect to a rotationally intermediate position;

the rotationally intermediate position does not drive the latch retractor into a latchbolt-retracting position; and rotation of any one of the coaxial cams in either the clockwise direction or the counterclockwise directions from the rotationally intermediate position operates to drive the latch retractor into a latchbolt-retracting position.

7. The mortise lockset of claim 5, wherein the hub assembly comprises a spindle hub subassembly selectively coupled for cooperative rotation with a coaxial cam subassembly.

8. The mortise lockset of claim 7, wherein the spindle hub subassembly is nested for rotation within the coaxial cam subassembly.

9. The mortise lockset of claim 7, wherein the spindle hub subassembly comprises a pair of independently rotatable spindle hubs.

10. The mortise lockset of claim 7, wherein the coaxial cam subassembly comprises two independently rotatable operating cams.

11. The mortise lockset of claim 1, wherein the two independently rotatable operating cams of the coaxial cam subassembly each cam the latch retractor, which is mounted for pivotal rotation about an axis eccentric to that of the hub assembly.

12. A clutching mortise lockset comprising:

a mortise lockset case configured for insertion into a door mortise;

a latchbolt enclosed at least partially within the mortise lockset case and guided for movement between positions in which the latchbolt extends out of the case and in which the latchbolt is substantially retracted within the case;

a latch retractor, enclosed within the mortise lockset case, operable to retract the latchbolt;

a hub assembly comprising a pair of coaxial cams, each operable to rotate, independently of the other, both counterclockwise and clockwise with respect to a rotationally intermediate position, in order to drive the latch retractor into a latchbolt-retracting position;

first and second handle-operated spindles each configured for selective operative engagement with the hub assembly;

a clutch enclosed within the mortise lockset case operative between engaged and disengaged positions;

a faceplate-accessible clutchworks operating the clutch and enabling a user to switch between access-enabling and access-denying configurations that respectively enable and disable an outside handle-operated spindle to operate the hub assembly to drive the latch retractor into the latchbolt-retracting position;

wherein the clutch, when engaged, rotationally interlocks a non-selected one of the first and second handle-operated spindles, opposite the selected handle-operated spindle, with a latch-retracting actuating portion of the hub assembly, thereby operatively enabling the non-selected spindle to retract the latchbolt; and wherein the clutch, when disengaged, rotationally decouples the non-selected spindle from the latch-retracting actuating portion of the hub assembly, thereby allowing the non-selected spindle to turn without retracting the latchbolt.

13. The clutching mortise lockset of claim 12, further comprising divaricate cam projections on each of the coaxial cams adapted, when rotated in both clockwise and counterclockwise directions, to drive the latch retractor into a latchbolt-retracting position.

14. The clutching mortise lockset of claim 12, wherein the first and second door handle-operated spindles are permanently rotationally decoupled from each other so that operative rotation of either handle-operated spindle does not rotate the opposite handle-operated spindle, even when the clutchworks is in the access-enabling configuration configuring the outside handle-operated spindle for operative movement of the hub assembly.

15. The clutching mortise lockset of claim 12, wherein the faceplate-accessible clutchworks comprises a user-actuated rocker with a clutch dog to enable the user to selectively engage and disengage the clutch.

16. The clutching mortise lockset of claim 12, wherein the faceplate-accessible clutchworks comprises a pair of buttons recessed in a faceplate of the mortise lockset.

17. The clutching mortise lockset of claim 12, further comprising a spring-biased escapement mechanism, wherein the escapement mechanism:

enables a user to toggle the faceplate-accessible clutchworks into the clutch-engagement position even when a corresponding portion of the hub assembly is rotationally misaligned with respect to the clutch, the misalignment preventing the clutch from operatively engaging the corresponding portion of the hub assembly; and spring biases the user-actuated clutch into operative clutching engagement with the corresponding portion of the hub assembly after that portion rotates into a rotationally aligned position.

18. The clutching mortise lockset of claim 12, wherein the faceplate-accessible clutchworks comprises a pivotally-mounted lever arm operative to move a rotationally interlocking clutch dog between engaged and disengaged positions with respect to the latch-retracting portion of the hub assembly.

19. The clutching mortise lockset of claim 18, wherein the faceplate-accessible clutchworks further comprises:

a pair of interconnected slides operative to urge the lever arm up or down; and a leaf spring mounted on one of the slides that is operative, in a spring-enabling position of the slide, to bias the lever arm toward a clutch-engaging position, and that is inoperative, in a spring-disabling position of the slide, to bias the lever arm toward a clutch-engaging position.

* * * * *